US006212994B1

(12) United States Patent
Estrabrooks

(10) Patent No.: US 6,212,994 B1
(45) Date of Patent: Apr. 10, 2001

(54) POSITIVE DISPLACEMENT ROTARY MACHINE

(76) Inventor: David A. Estrabrooks, 50 Water St., Newburyport, MA (US) 01950

( * ) Notice: Subject to any disclaimer, the term of this patent is extended or adjusted under 35 U.S.C. 154(b) by 0 days.

(21) Appl. No.: 09/326,962

(22) Filed: Jun. 7, 1999

(51) Int. Cl.[7] ..... F01B 1/06; F04B 19/02

(52) U.S. Cl. ..... 91/493; 92/58; 92/72; 417/462; 91/498

(58) Field of Search ..... 417/462, 515, 417/440, 466, 572, 464; 91/493, 498; 92/58, 72

(56) References Cited

U.S. PATENT DOCUMENTS

| | | | | |
|---|---|---|---|---|
| 1,093,278 | | 4/1914 | Loftus . | |
| 1,166,999 | | 1/1916 | Loftus . | |
| 3,780,710 | * | 12/1973 | Przybylski | 123/246 |
| 3,786,727 | * | 1/1974 | Baumann | 91/493 |
| 3,810,721 | * | 5/1974 | Eyer | 417/440 |
| 4,137,019 | * | 1/1979 | Hofmann | 417/462 |
| 5,090,295 | | 2/1992 | Cunningham et al. . | |
| 5,391,059 | * | 2/1995 | Hallund | 417/273 |
| 5,478,218 | | 12/1995 | Gu . | |
| 5,622,052 | * | 4/1997 | ahnle et al. | 60/487 |

* cited by examiner

*Primary Examiner*—Teresa Walberg
*Assistant Examiner*—Jeffrey Pwu

(57) ABSTRACT

A positive displacement rotary machine includes a piston rotor rotatable about a first axis and including a number of pistons equally spaced about the first axis and rotatably mounted about their axes on the piston rotor; a chamber rotor rotatable about a second axis spaced from the first axis, including a central common chamber and a number of radial fluid chambers arranged in diametrically opposed pairs across the common chamber, and guide tracks extending between opposing pairs of radial chambers across the common chamber for kinematically constraining each of the pistons as they move from one of their associated radial chambers to the other through the common chamber, and intake and exhaust ports for introducing and exhausting fluid from the radial chambers.

39 Claims, 23 Drawing Sheets

$$R_{rc} = \sqrt{R_m^2 - R^2}$$

$$L = \sqrt{R^2 + P^2}$$

POSITIVE DISPLACEMENT ROTARY MACHINE

FIELD OF INVENTION

This invention relates to a new and improved positive displacement rotary machine, and more particularly to such a machine which operates at uniform angular velocity, is inherently statically and dynamically balanced and is adaptable as, e.g., a pump, fluid motor, engine, compressor, expandor, vacuum pump.

BACKGROUND OF INVENTION

Conventional positive displacement rotary machines such as piston, gear, and vane type suffer from high impact forces due to engagement of the parts and unbalanced vane and piston inertia forces. This results in excessive noise and wear. Gear and vane devices also have inherently high leakage flow because of the line contact sealing. Although radial and axial piston types have surface contact sealing, much lower leakage flow, and no impact forces, their unbalanced inertia forces tend to make them noisy and produce vibrations particularly at high speeds. In addition, piston machines have higher weight to power ratio than rotary gear and vane devices.

SUMMARY OF INVENTION

It is therefore an object of this invention to provide a new improved positive displacement rotary machine.

It is a further object of this invention to provide such a machine which is operable in a variety of applications, e.g., fluid motor, fluid pump, compressor, expandor, vacuum pump, and engine.

It is a further object of this invention to provide such a machine in which all moving parts including pistons rotate at uniform angular velocity.

It is a further object of this invention to provide such a machine which is inherently statically and dynamically balanced.

It is a further object of this invention to provide such a machine which is capable of efficient high speed and high pressure fluid power operation.

It is a further object of this invention to provide such a machine in which pistons rotate uniformly without impact, with continuous sinusoidal sliding surface contact, complete mechanical balance and with very quiet operation.

It is a further object of this invention to provide such a machine in which rotary pistons are coupled with only two uniformly rotating mechanical elements resulting in simple linear design, and low cost piston machine that can be manufactured with common and conventional techniques.

It is a further object of this invention to provide such a machine which is very compact with high displacement per unit volume.

It is a further object of this invention to provide such a machine which permits of large intake/exhaust ports with low shear and unobstructed flow.

It is a further object of this invention to provide such a machine which has high volumetric efficiency at minimum clearance, very low leakage flow, and low friction hydrodynamic fluid bearing surface piston sealing.

It is a further object of this invention to provide such a machine which has improved energy efficiency.

The invention results from the realization that a new and improved positive displacement rotary machine which provides uniform angular velocity and inherent static and dynamic balance with good volumetric efficiency and low weight to power ratio can be effected using a piston rotor rotatable about a first axis and having a number of rotatable pistons engaged with a guide track on a chamber rotor rotatable about a second axis to travel through a central common chamber between pairs of aligned diametrically opposed radial fluid chambers so that the pistons are kinematically constrained to move with sinusoidal motion between their associated radial chambers smoothly, quietly and without impact while the rotors and pistons move with pure rotary motion.

This invention features a positive displacement rotary machine. There is a piston rotor uniformly rotatable about a first axis and including a number of pistons equally spaced about the first axis and uniformly rotatably mounted about their axes on the piston rotor. There is a chamber rotor uniformly rotatable about a second axis spaced from the first axis, for relative rotation in 2/1 respectively between the piston and chamber rotor, including a central common chamber and a number of radial fluid chambers arranged in diametrically opposed pairs across the common chamber, and a guide track extending between opposing pairs of radial chambers across the common chamber for kinematically constraining each of the pistons as they move from one of their associated radial chambers to the other through the common chamber. There are intake and exhaust ports for introducing and exhausting fluid from the radial chambers.

In a preferred embodiment each of the pistons and its associated radial chambers may have the same cross-sectional shape. The guide tracks may be continuous through the common chamber. The guide tracks may form a part of their associated pairs of radial chambers. The pistons may have their positions which engage their associated guide tracks conforming in shape to the shape of the guide tracks. The pistons in the radial chambers may be all in the same plane. The guide tracks may be generally triangular in cross-section shape. The triangular guide tracks may have an apex of approximately 90° or less. For maximum displacement, the ratio of the radius of the radial chambers to that of the common chamber may be twice the cosine of $\phi$ where $\phi=90°/N$ where N is the number of pistons. The length of the piston and the width of the piston may be determined for maximum displacement for a given number of pistons N and the diameter of chamber rotor, $2 \cdot Rm$.

The intake and exhaust ports may each extend along the chamber rotor over the period when each piston moves between top dead center and bottom dead center in each of its associated pair of radial chambers. One of the rotors may be connected to a source of rotary power. The intake port may be connected to a source of fluid and the fluid may be provided pressurized at the exhaust port and the rotary machine may be operated as a fluid pump. The intake port may be connected to a source of pressurized fluid and one of the rotors may be connected to a drive device for providing output rotary power and the rotary machine may be operated as a fluid motor. The exhaust port may be connected to a container to be evacuated and may extend along the chamber rotor over the period when each piston approaches bottom dead center. One of the rotors may be connected to a drive device for providing rotary power and the rotary machine may be operated as a vacuum pump. The exhaust port may be connected to a compressor tank and the intake port may extend along the chamber rotor over the period when each piston approaches top dead center. One of the rotors may be connected to a drive device for providing rotary power and the rotary machine may be operated as a compressor or expandor. The intake and exhaustor ports may extend along the chamber rotor over the period when each piston moves from bottom dead center of its exhaust stroke in one of its associated radial chambers to bottom dead center of the intake stroke in the other of its associated radial chambers. A valve may be provided in the port area for varying the displacement. One of the rotors may be connected to a drive device for providing rotary output power and the rotary machine may be operated as a two-stroke scavenged intake and exhaust engine.

The chamber rotor may be connected to a source of rotary power or it may be connected to a drive device. Each of the pistons may include at least one circumferential seal for sealing between the piston and radial chamber. The radial chambers may extend through the chamber rotor to its outer periphery. A thrust washer or pressurized fluid may seal the piston and chamber rotor faces. The housing may have a peripheral wall for closing the outer periphery of the chamber rotor. Each of the radial chambers may include an annular seal for sealing between each radial chamber and the housing. The intake and exhaust ports may be in the peripheral wall and/or a side wall. The radial chambers may be open on opposite sides and the housing may have side walls for closing the open opposite sides. Each piston may include a piston pivot pin which is rotatably mounted in the piston rotor, integral with the piston, or the piston rotor may include a number of fixed pivot pins, one for rotatably mounting each of the pistons. The vacuum pump may include a vacuum valve for maintaining the vacuum at the intake port. The compressor may include a pressure valve for maintaining the pressure at the exhaust port.

This invention also features a positive displacement rotary fluid pump including a piston rotor rotatable about a first axis and including a number of pistons equally spaced about the first axis and rotatably mounted about their axes on the piston rotor. There is a chamber rotor rotatable about a second axis spaced from the first axis including a center common chamber and a number of radial fluid chambers arranged in diametrically opposed pairs across the common chamber, and guide tracks extending between opposing pairs of radial chambers across the common chamber for kinematically constraining each of the pistons as they move from one of their associated radial chambers to the other through the common chamber. There are intake and exhaust ports for introducing and exhausting fluid from the radial chambers. The intake and exhaust ports each extend along the chamber rotor over the period when each piston moves between top dead center and bottom dead center in each of its associated pair of radial chambers. One of the rotors is connected to a source of rotary input power. The intake port is connected to a source of fluid and the fluid is provided pressurized at the exhaust port.

The invention also features a positive displacement rotary fluid motor. There is a piston rotor rotatable about a first axis and including a number of pistons equally spaced about the first axis and rotatably mounted about their axes on the piston rotor. There is a chamber rotor rotatable about a second axis spaced from the first axis and including a central common chamber and a number of radial fluid chambers arranged in diametrically opposed pairs across the common chamber. There are guide tracks extending between opposing pairs of radial chambers across the common chamber for kinematically constraining each of the pistons as they move from one of their associated radial chambers to the other through the common chamber. There are intake and exhaust ports for introducing and exhausting fluid from the radial chambers. The intake and exhaust ports each extend along the chamber rotor over the period when each piston moves between top dead center and bottom dead center in each of its associated pair of radial chambers. The intake port is connected to a source of pressurized fluid and one of the rotors is connected to a drive device for providing output rotary power.

This invention also features a positive displacement rotary vacuum pump including a piston rotor rotatable about a first axis and including a number of pistons equally spaced about the first axis and rotatably mounted about their axis on the piston rotor. There is a chamber rotor rotatable about a second axis spaced from the first axis including a central common chamber and a number of radial fluid chambers arranged in radially opposed pairs across the common chamber, and guide tracks extending between opposing pairs of radial chambers across the common chamber for kinematically constraining each of the pistons as they move from one of the associated radial chambers to the other through the common chamber. There are intake and exhaust ports for introducing and exhausting fluid from the radial chambers. The exhaust port is connected to a container to be evacuated and extends along the chamber rotor over the period when each piston approaches bottom dead center. One of the rotors is connected to a drive device for providing rotary input power.

This invention also features a positive displacement rotary compressor. There is a piston rotor rotatable about a first axis and including a number of pistons equally spaced about the first axis and rotatably mounted about their axes on the piston rotor. There is a chamber rotor rotatable about a second axis spaced from the first axis including a central common chamber and a number of radial fluid chambers arranged in diametrically opposed pairs across the common chamber. There are guide tracks extending between opposing pairs of radial chambers across the common chamber for kinematically constraining each of the pistons as they move from one of their associated radial chambers to the other through the common chamber. There are intake and exhaust ports for introducing and exhausting fluid from the radial chambers. The exhaust port is connected to a compressor tank. The intake port extends along the chamber rotor over the period when each piston approaches top dead center and one of the rotors is connected a drive device for providing rotary input power.

This invention also features a positive displacement rotary two-stroke intake and exhaust scavenged engine. There is a piston rotor rotatable about a first axis and including a number of pistons equally spaced about the first axis and rotatably mounted about the axis on the piston rotor. There is a chamber rotor rotatable about a second axis spaced from the first axis including a central common chamber and a number of radial fluid chambers arranged in diametrically opposed pairs across the common chamber. There are guide tracks extending between opposing pairs of radial chambers across the common chamber for kinematically constraining each of the pistons as they move from one of their associated radial chambers to the other through the common chamber. There are intake and exhaust ports for introducing and exhausting fluid from the radial chambers. The intake and exhaust ports extend along the chamber rotor over the period when each piston moves from bottom dead center of its exhaust stroke in one of its associated radial chambers to bottom dead center of its intake stroke in the other of its associated radial chambers. One of the rotors is connected to a drive device for providing rotary output power.

DISCLOSURE OF PREFERRED EMBODIMENT

Other objects, features and advantages will occur to those skilled in the art from the following description of a preferred embodiment and the accompanying drawings, in which.

Figure 8A:
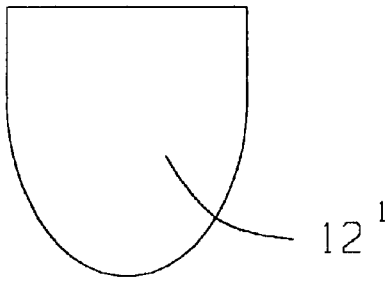
Figure 8B:
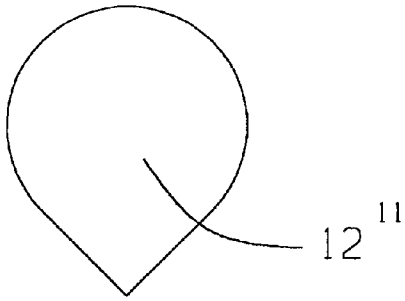
Figure 8C:
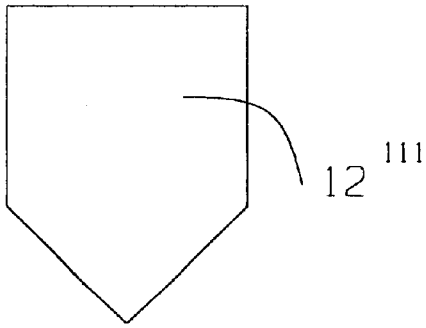
Figure 9:
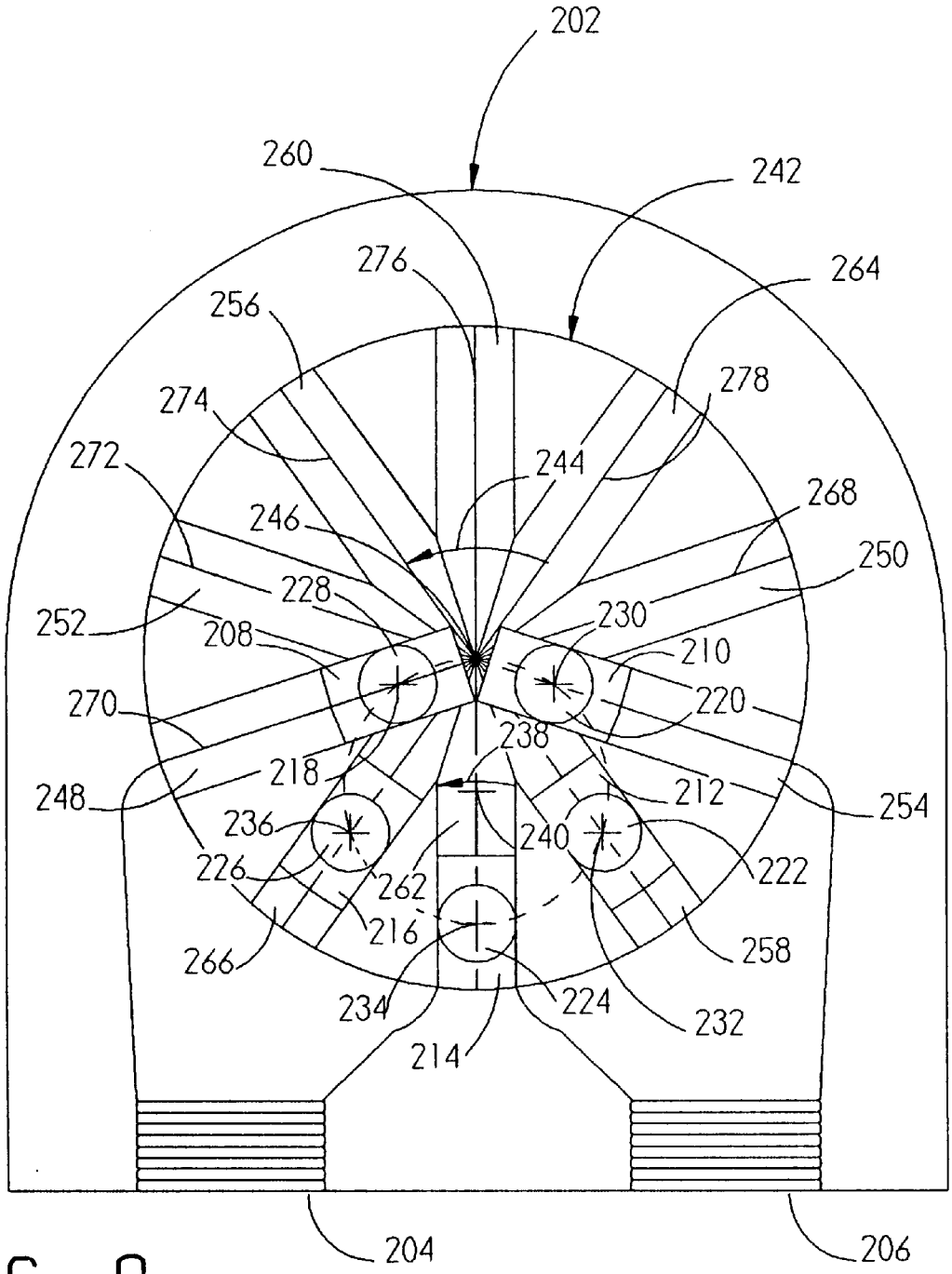
Figure 10:
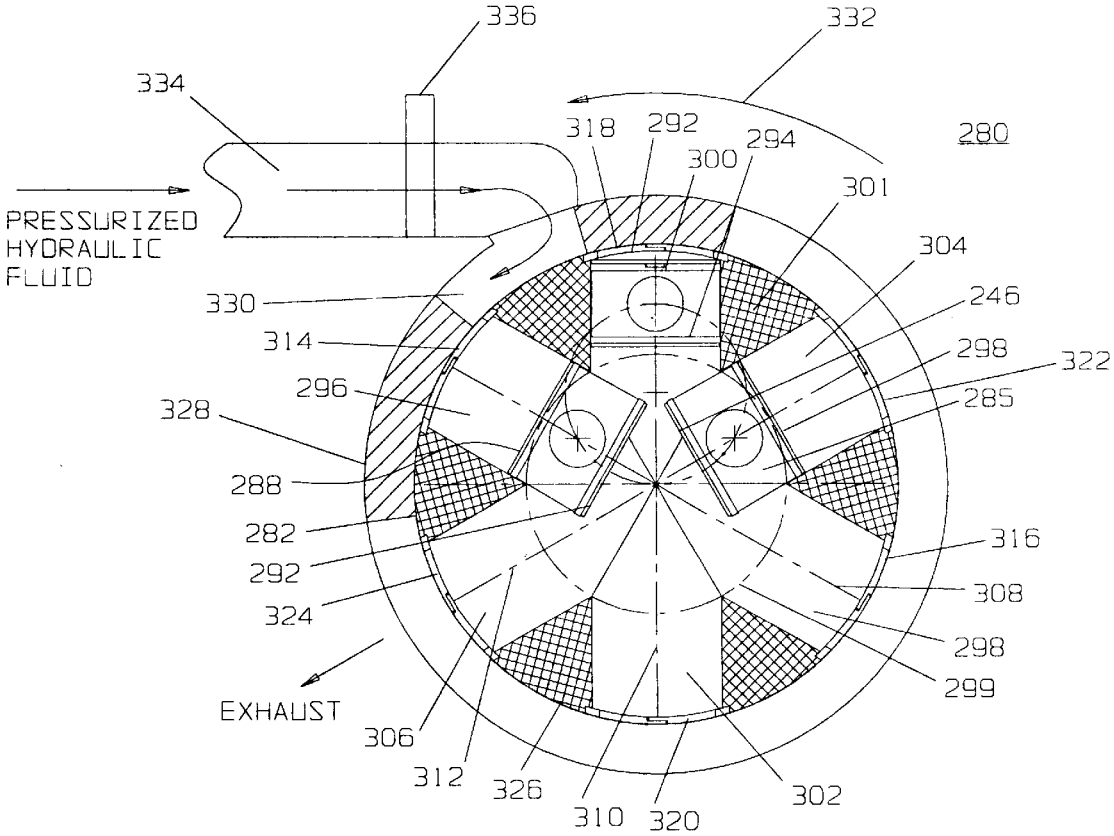
Figure 11:
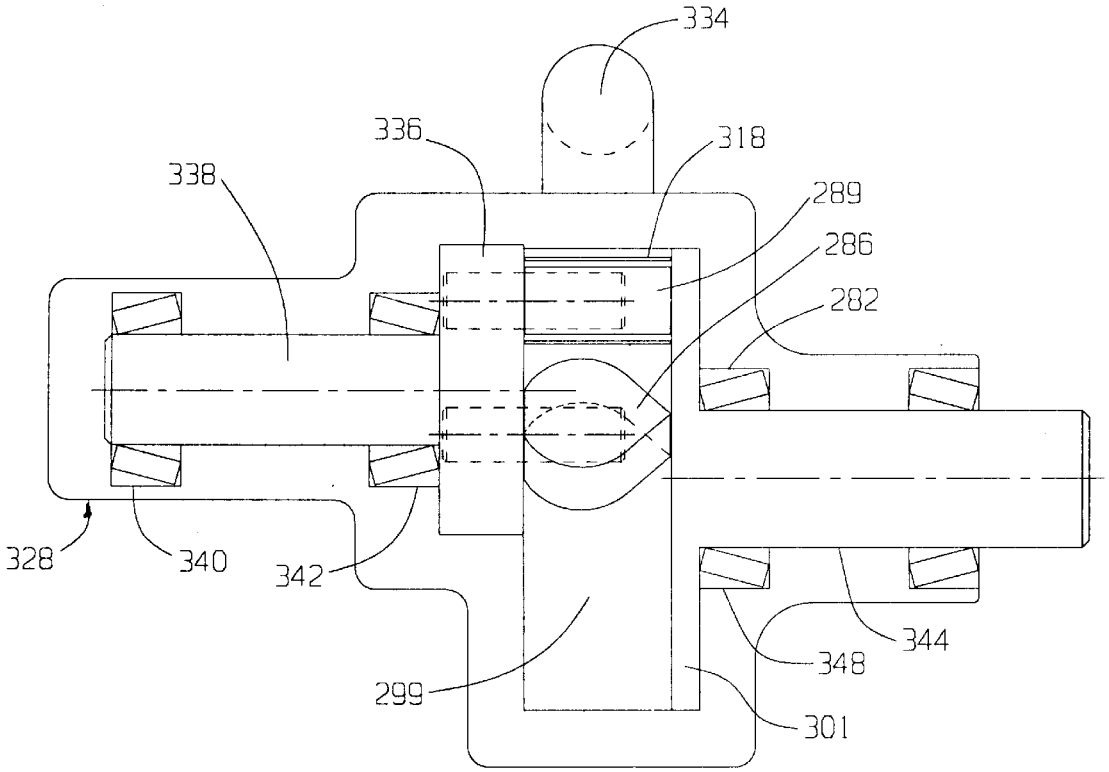
Figure 12:
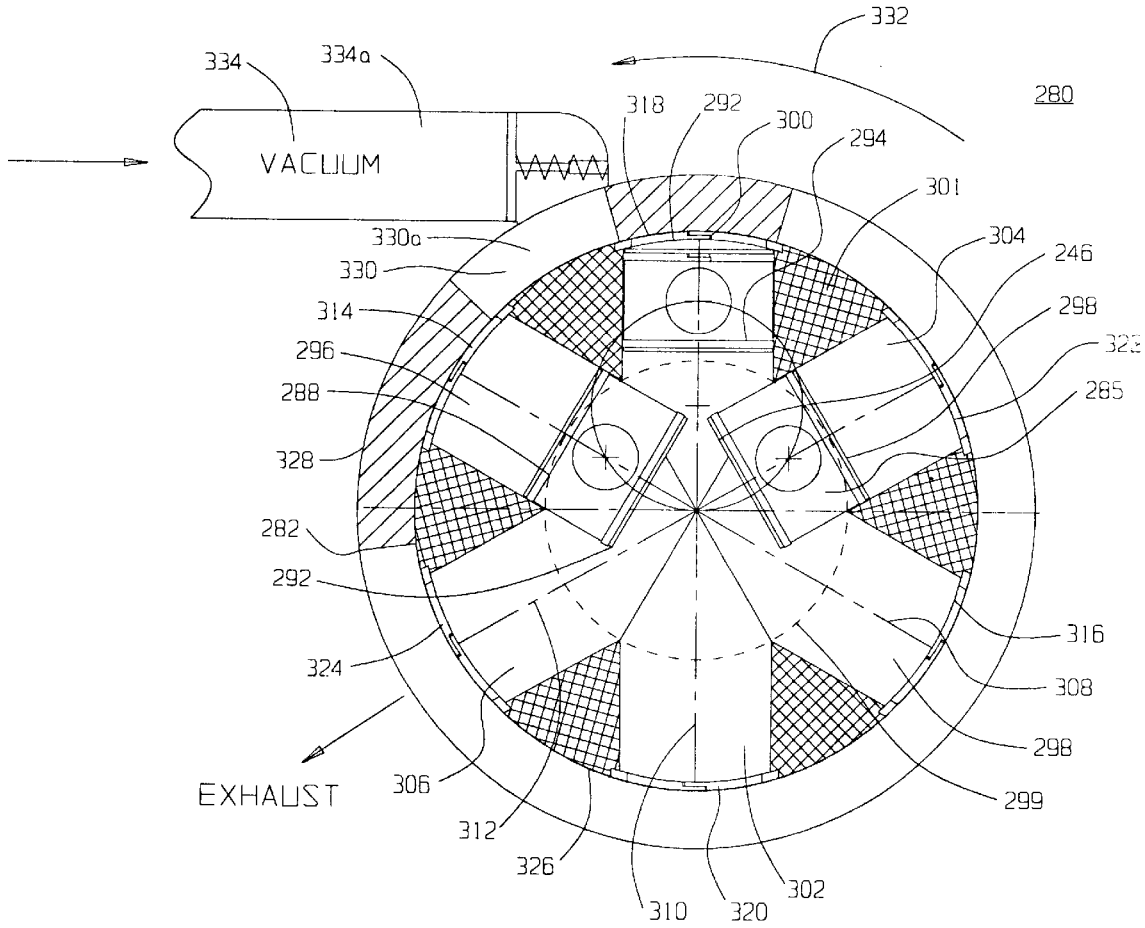
Figure 13:
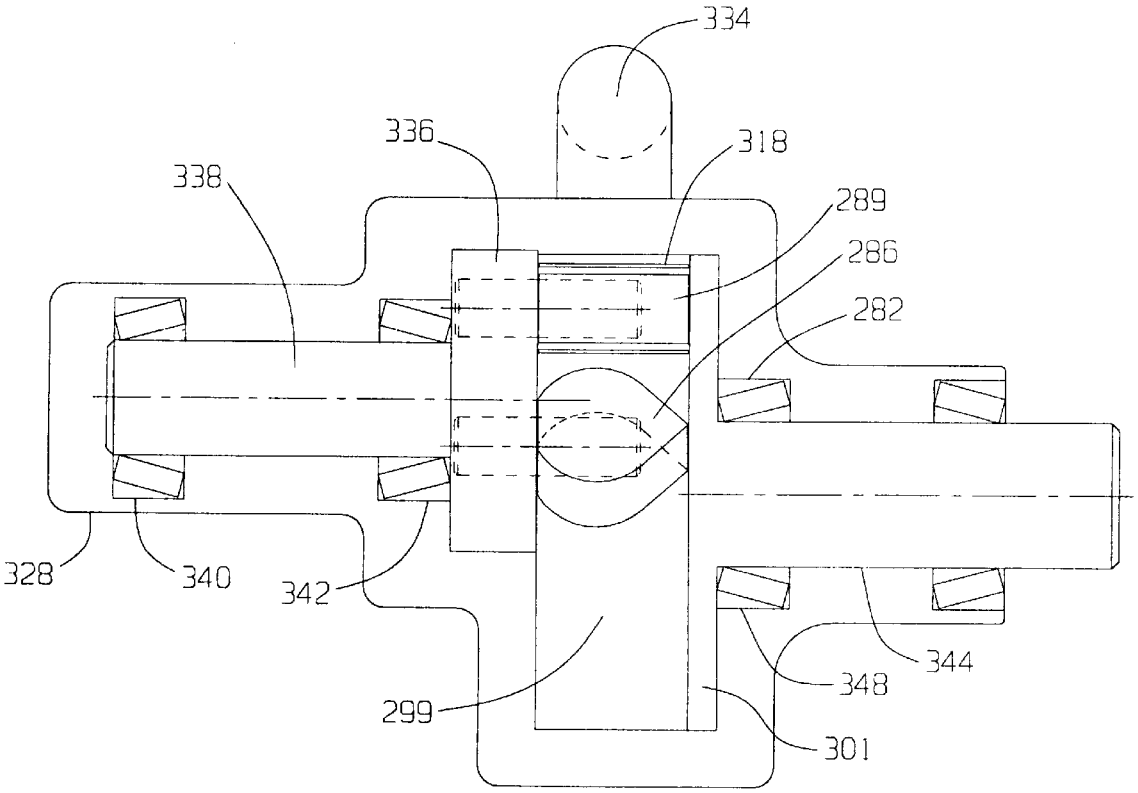
Figure 14:
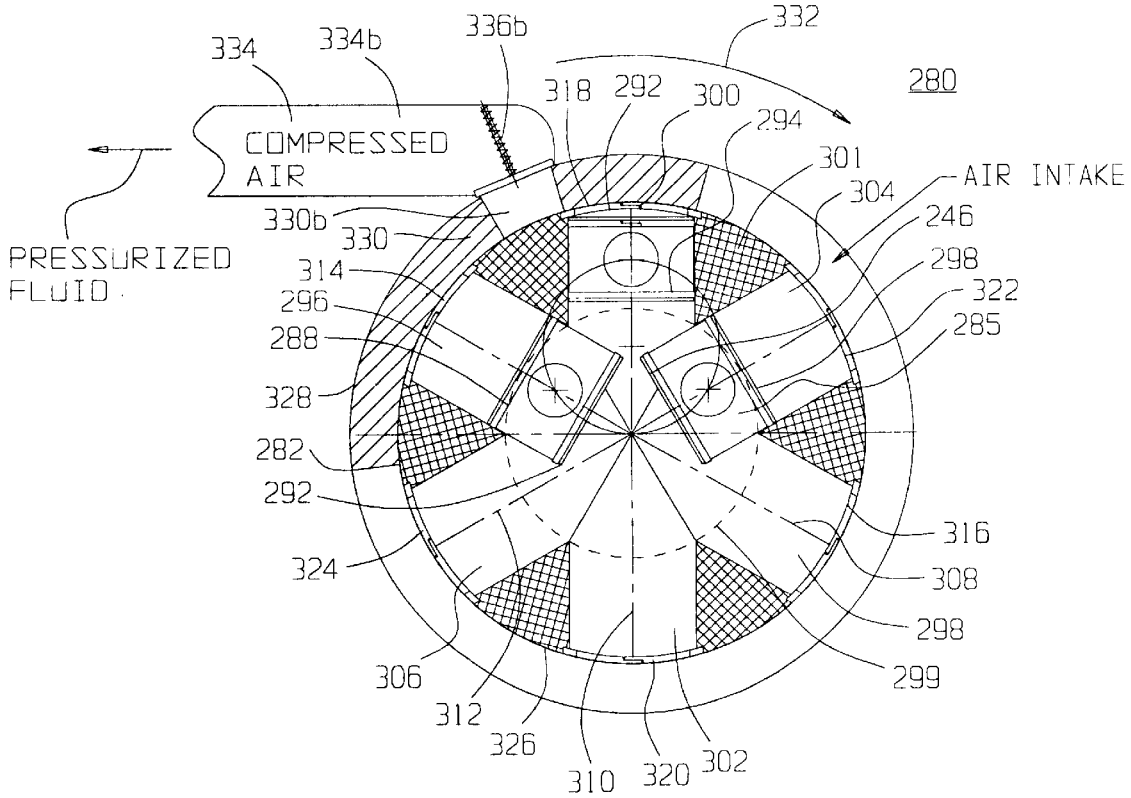
Figure 15:
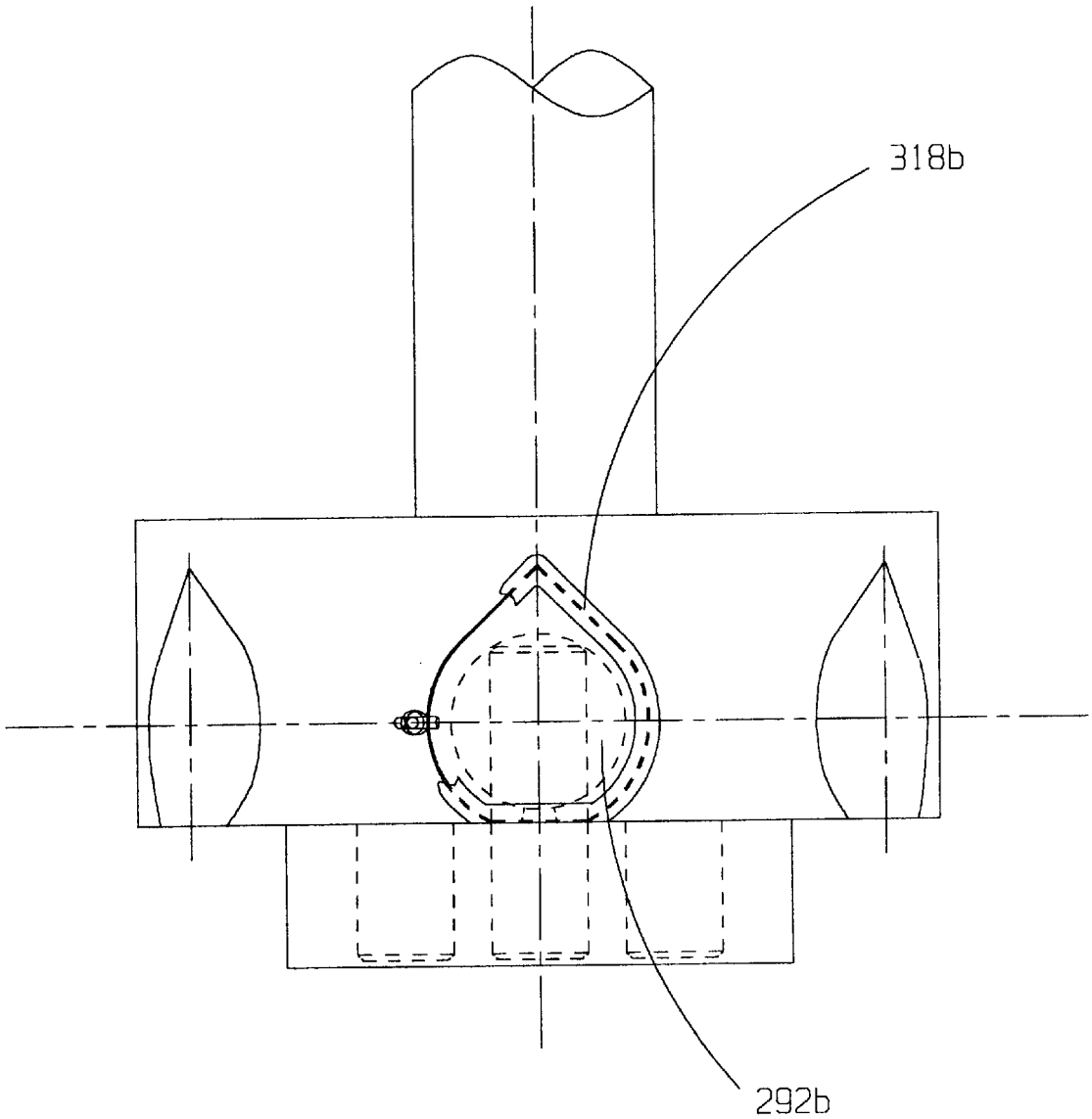
Figure 16:
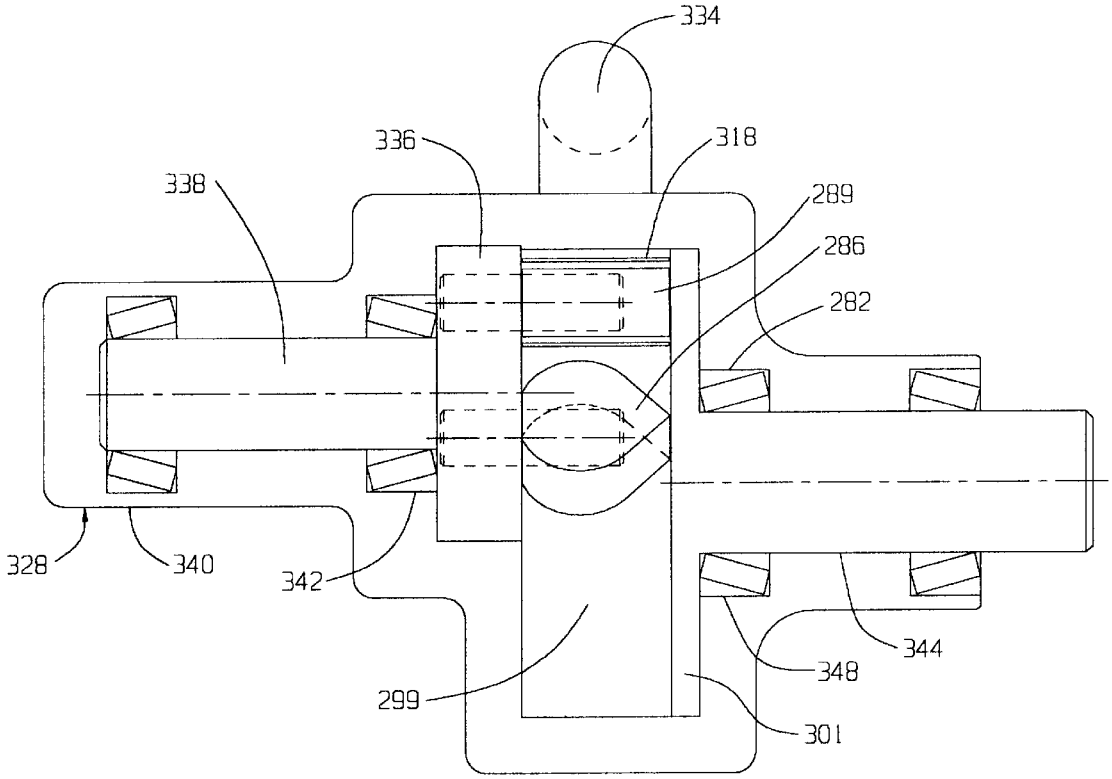
Figure 17:
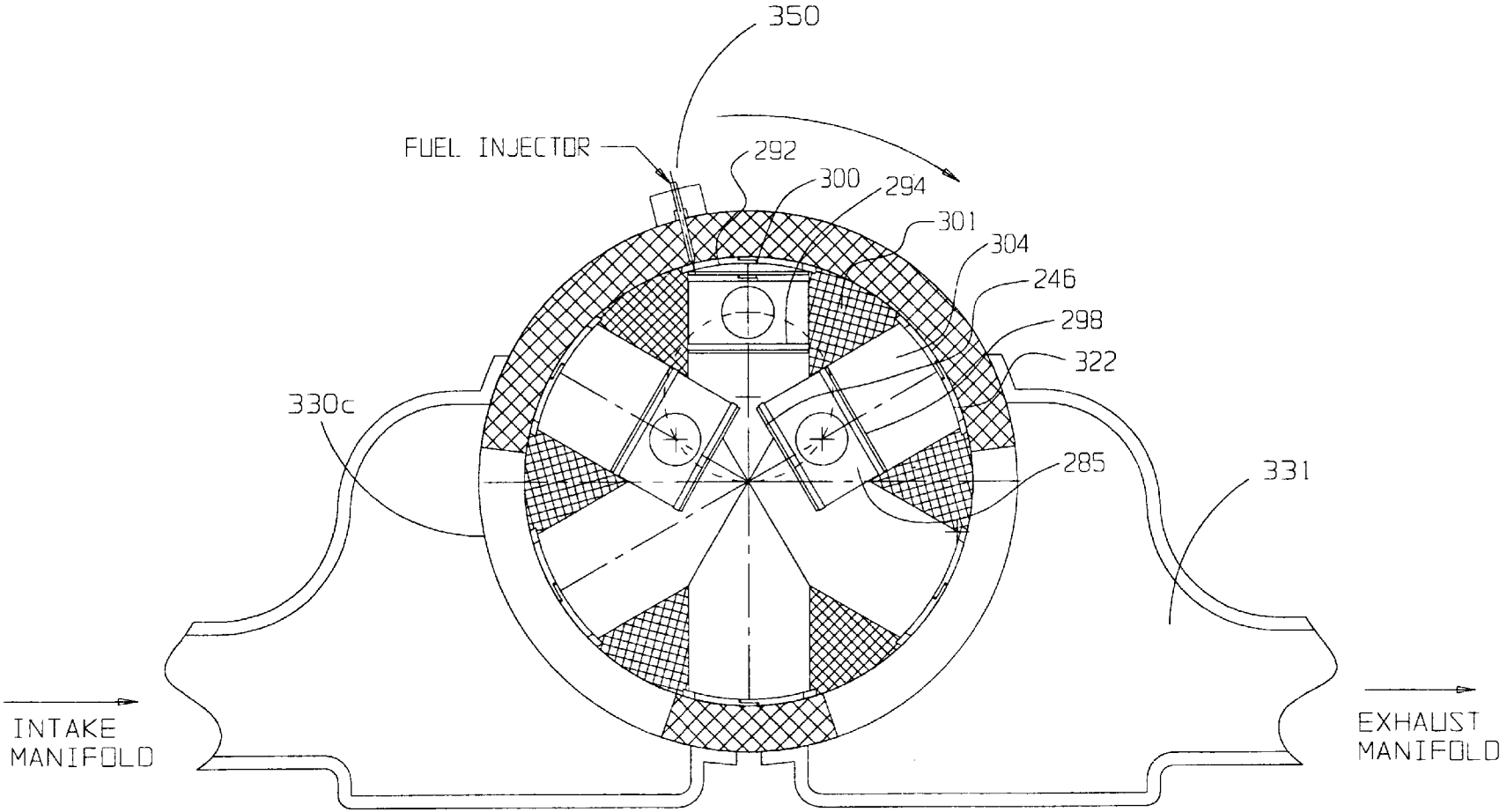
Figure 18:
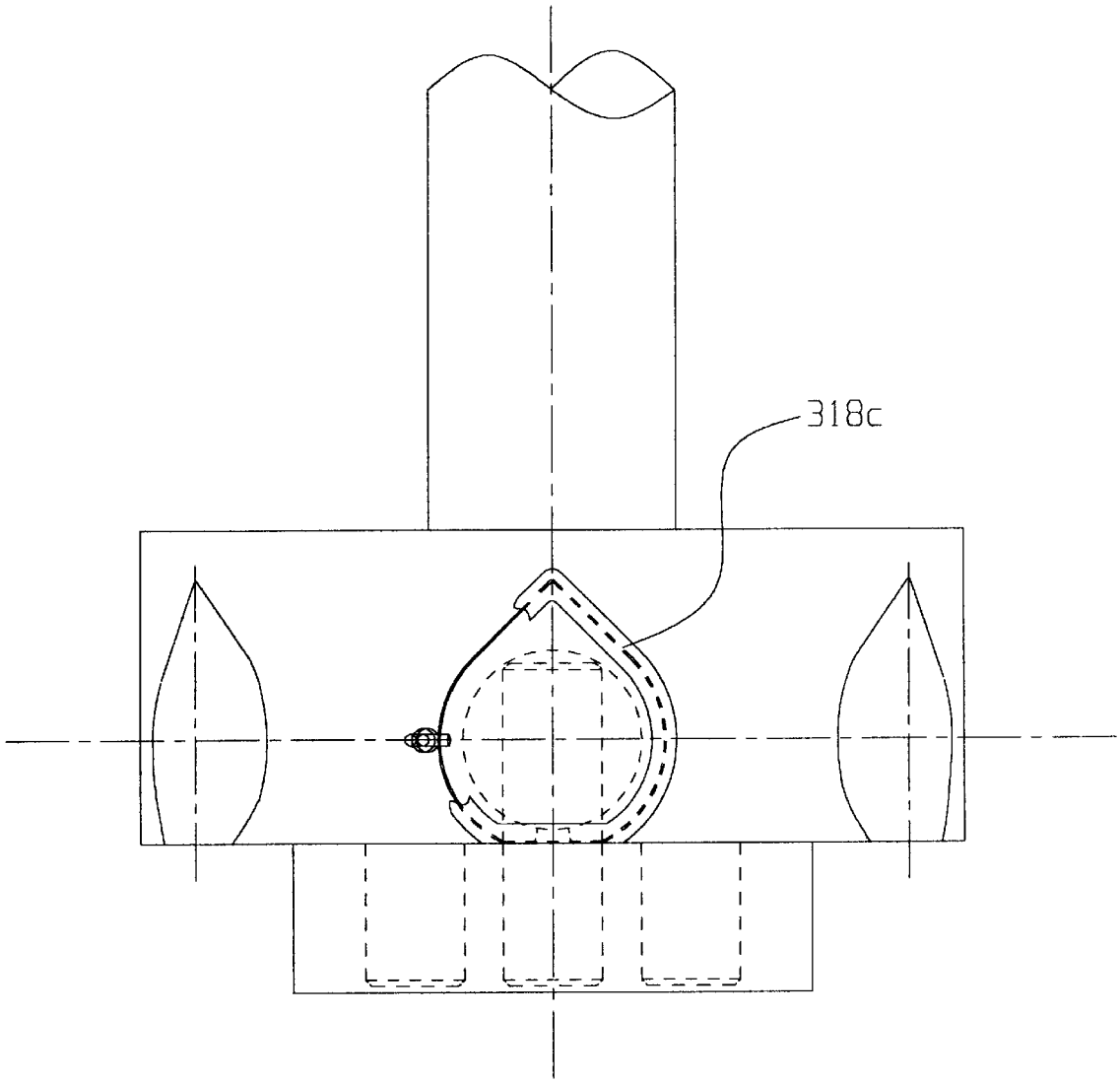
Figure 19:
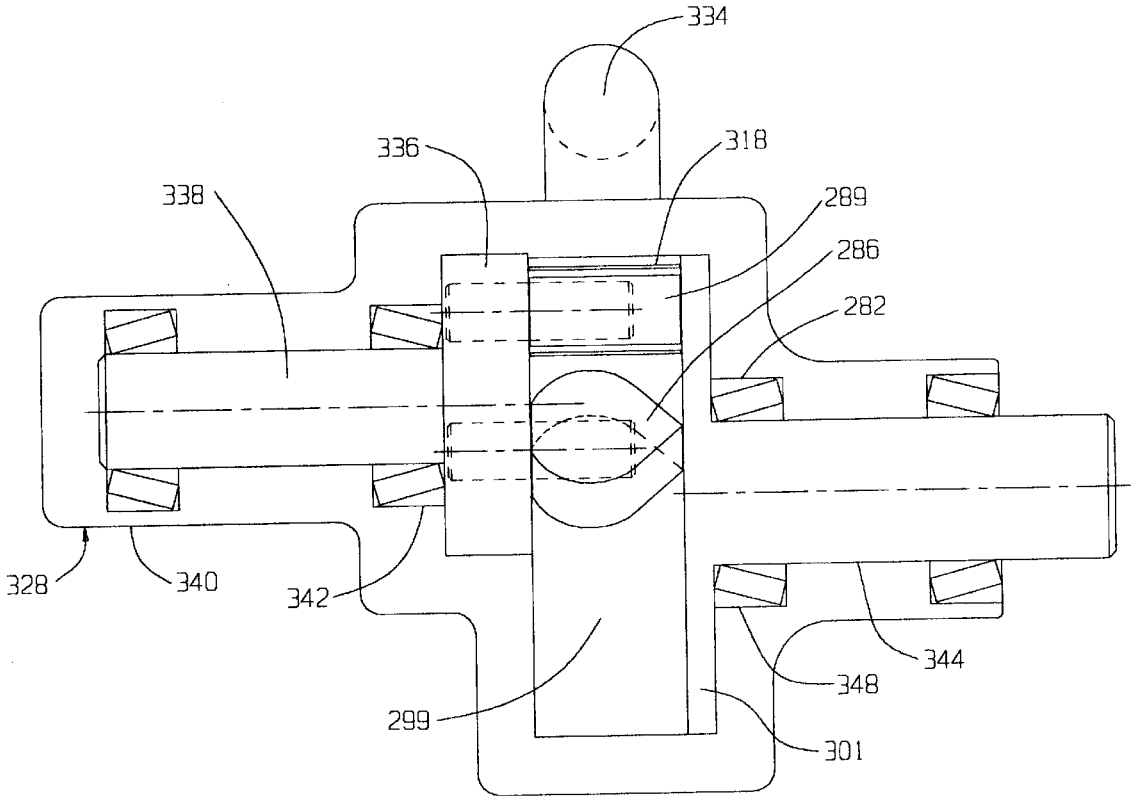
Figure 20:
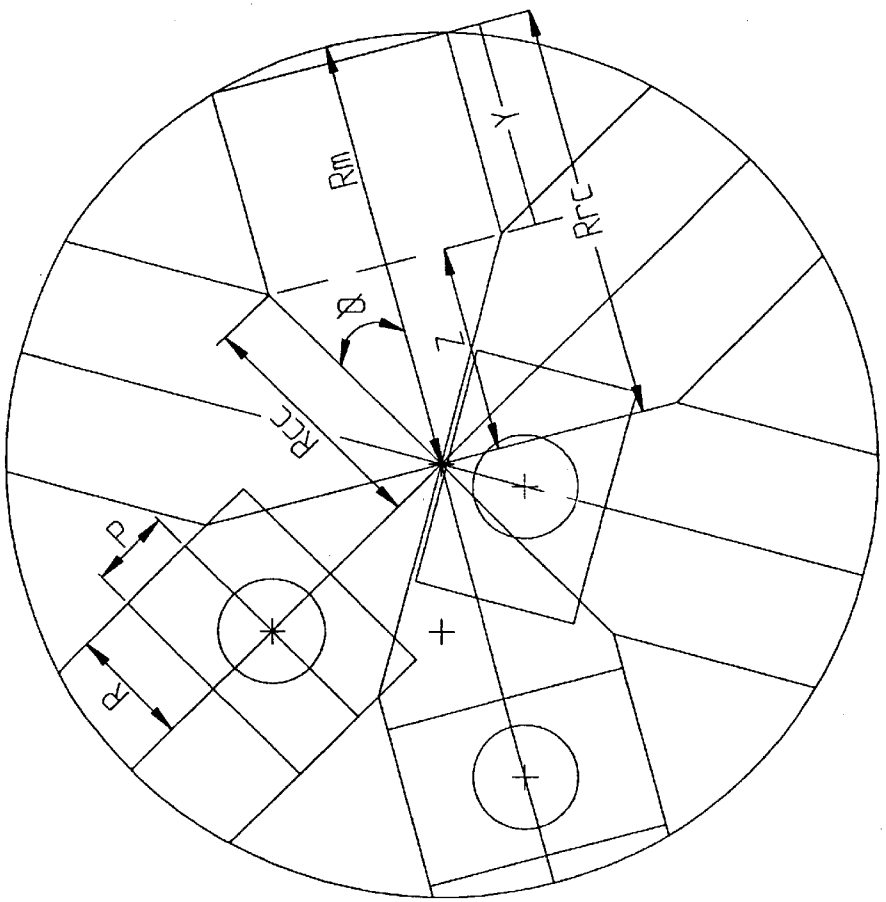
Figure 21:
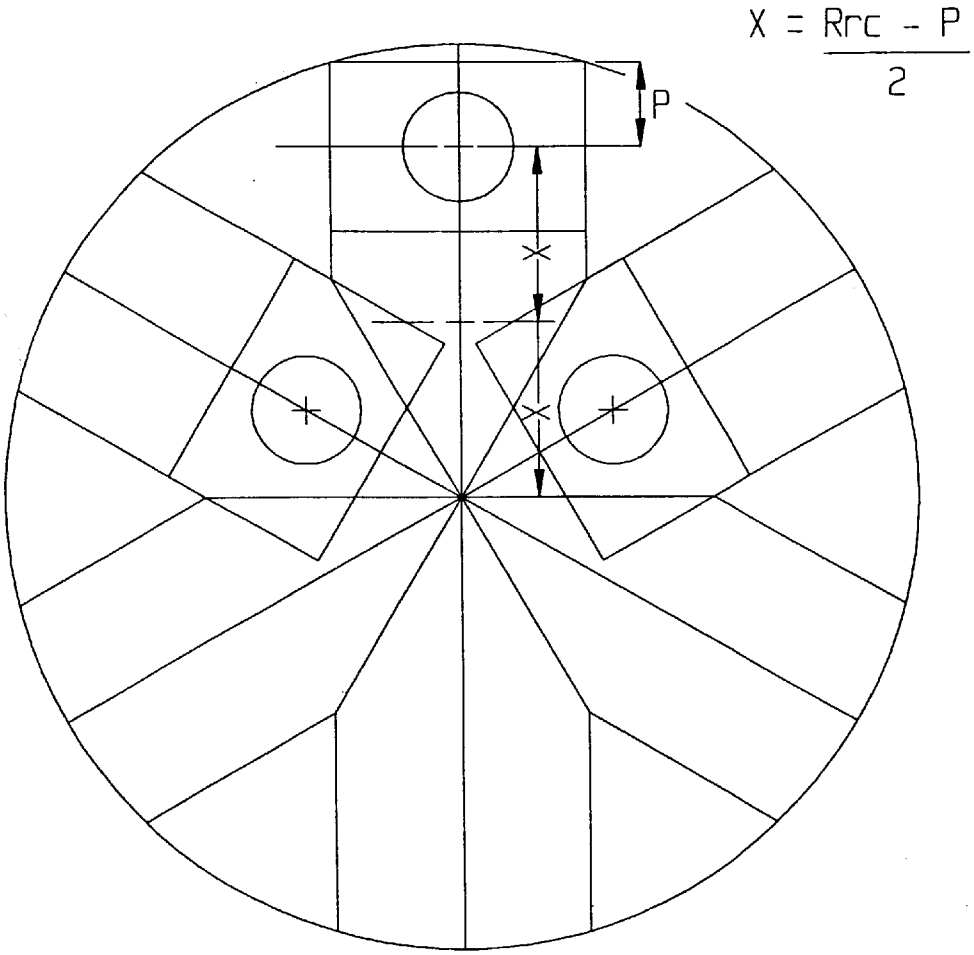
Figure 22:
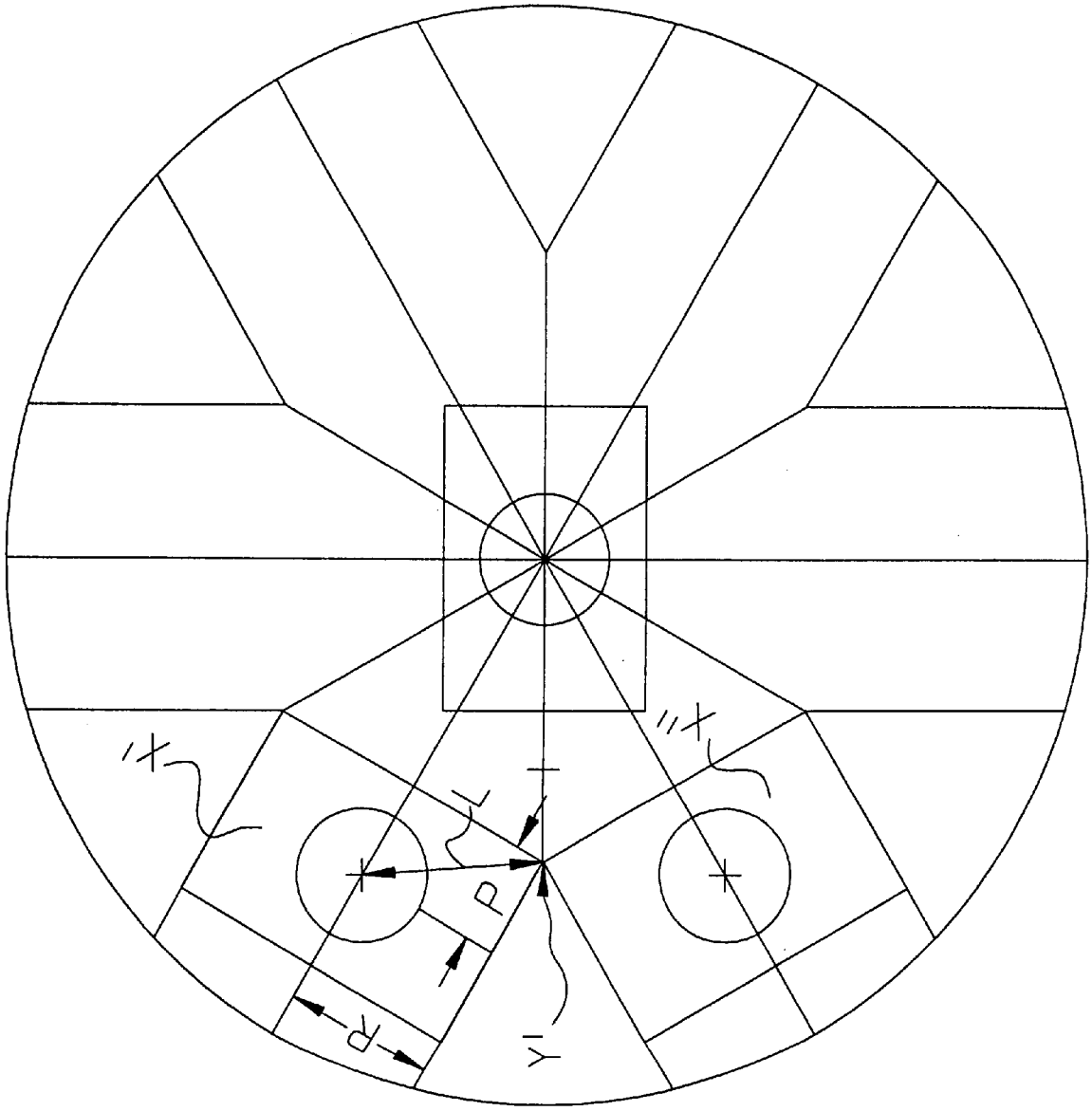
Figure 23:
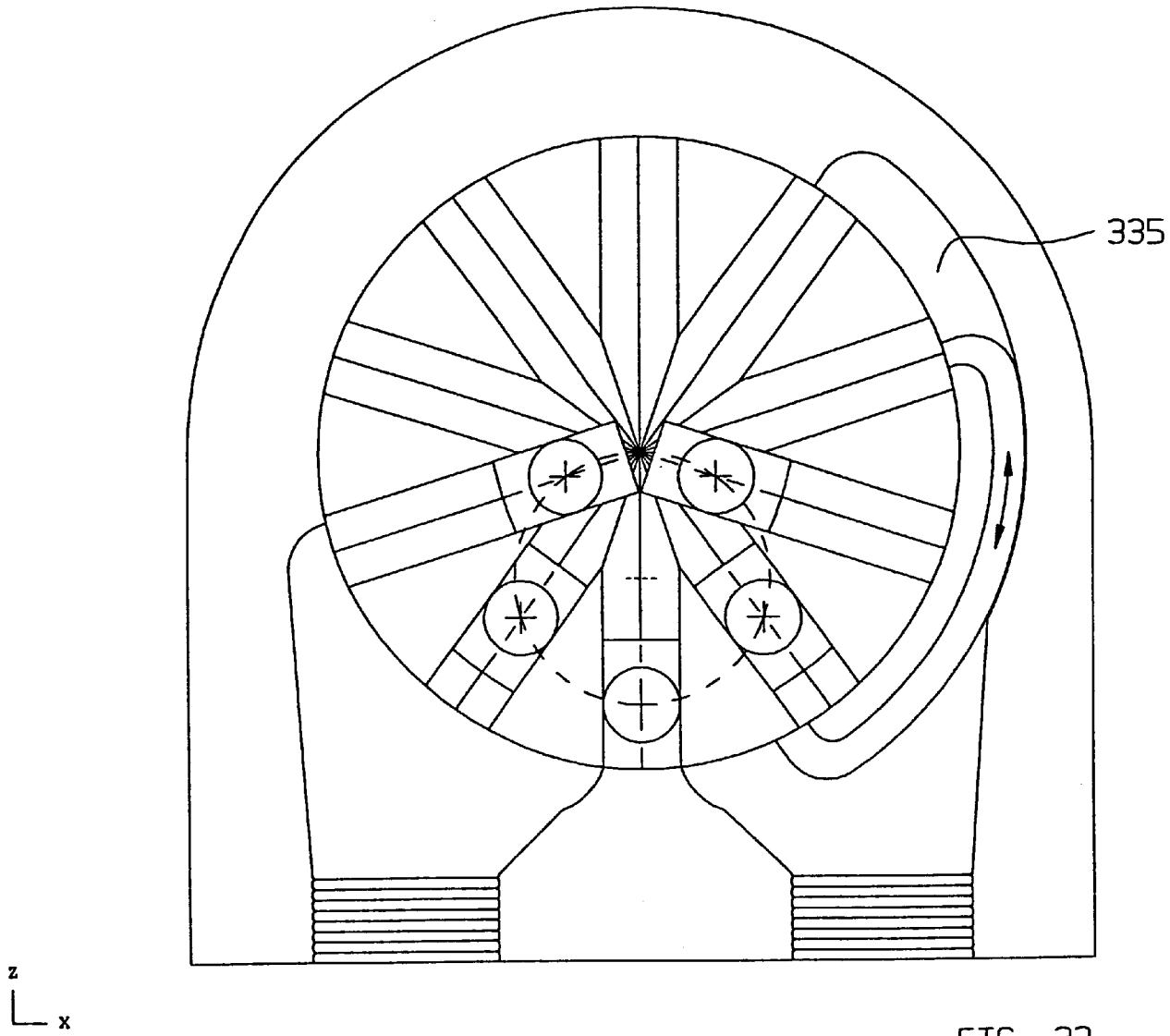

FIGS. 8A–C are schematic end elevational views of various piston and radial fluid chamber cross-sections;

FIG. 9 is a schematic sectional front elevational view of a positive displacement rotary machine according to this invention ported for operation as a fluid pump/motor;

FIG. 10 is a view similar to FIG. 9 of another construction of a fluid pump/motor using the positive displacement rotary machine of this invention;

FIG. 11 is a side elevational sectional view of the fluid pump/motor of FIG. 10;

FIG. 12 is a schematic sectional front elevational view of a positive displacement rotary machine according to this invention ported for operation as a vacuum pump;

FIG. 13 is a side elevational sectional view of the vacuum pump of FIG. 12;

FIG. 14 is a schematic sectional front elevational view of a positive displacement rotary machine according to this invention ported for operation as an air compressor, FIG. 15 is a schematic top view of the chamber and piston rotors of FIG. 14;

FIG. 16 is a side elevational sectional view of the air compressor of FIG. 14;

FIG. 17 is a schematic sectional front elevational view of a positive displacement rotary machine according to this invention ported for operation as an engine;

FIG. 18 is a schematic top view of the chamber and piston rotors of FIG. 17;

FIG. 19 is a side elevational sectional view of the engine of FIG. 17;

FIGS. 20, 21 and 22 are diagrammatic views illustrating certain lengths and angles of the rotary machine; and FIG. 23 is a schematic sectional front elevational view of a positive displacement rotary machine according to this invention with a sliding valve for variable displacement.

This invention relates to a positive displacement rotary machine which employs two rotors that rotate eccentric to one another with pure rotational motion yet provide linear sinusoidal motion between the pistons on one of the rotors, the piston rotor, and the chambers on the other of the rotors, the chamber rotor. Each piston is rotatably mounted on the piston rotor and cooperates with a pair of diametrically opposed radial fluid chambers on the chamber rotor by means of a guide track that kinematically constrains the piston as it moves from one of its radial chambers to the other through a central common chamber.

The result is an improved rotary machine which may be used for any manner of applications, for example, as a positive displacement device such as a fluid motor, fluid pump, compressor, expandor, vacuum pump or engine. Because all of the moving parts including the pistons rotate at a uniform angular velocity, the machine is statically and dynamically balanced and is capable of quiet and high-speed operation without impact. Furthermore, the machine admits of a high displacement per unit volume in a very compact package with improved energy efficiency. In addition, the design allows large intake and exhaust ports with low shear and unobstructed flow with high volumetric efficiency at minimum clearance and very low leakage flow. The operation of the machine may best be understood with reference to FIGS. 1–4 which show a top plan view with the piston rotor and housing omitted and the pistons engaged with their radial chambers on the chamber rotor. Although in these figures the number of pistons is chosen to be three, this is for illustrative purposes only as any number of pistons can be used.

Figure 1:
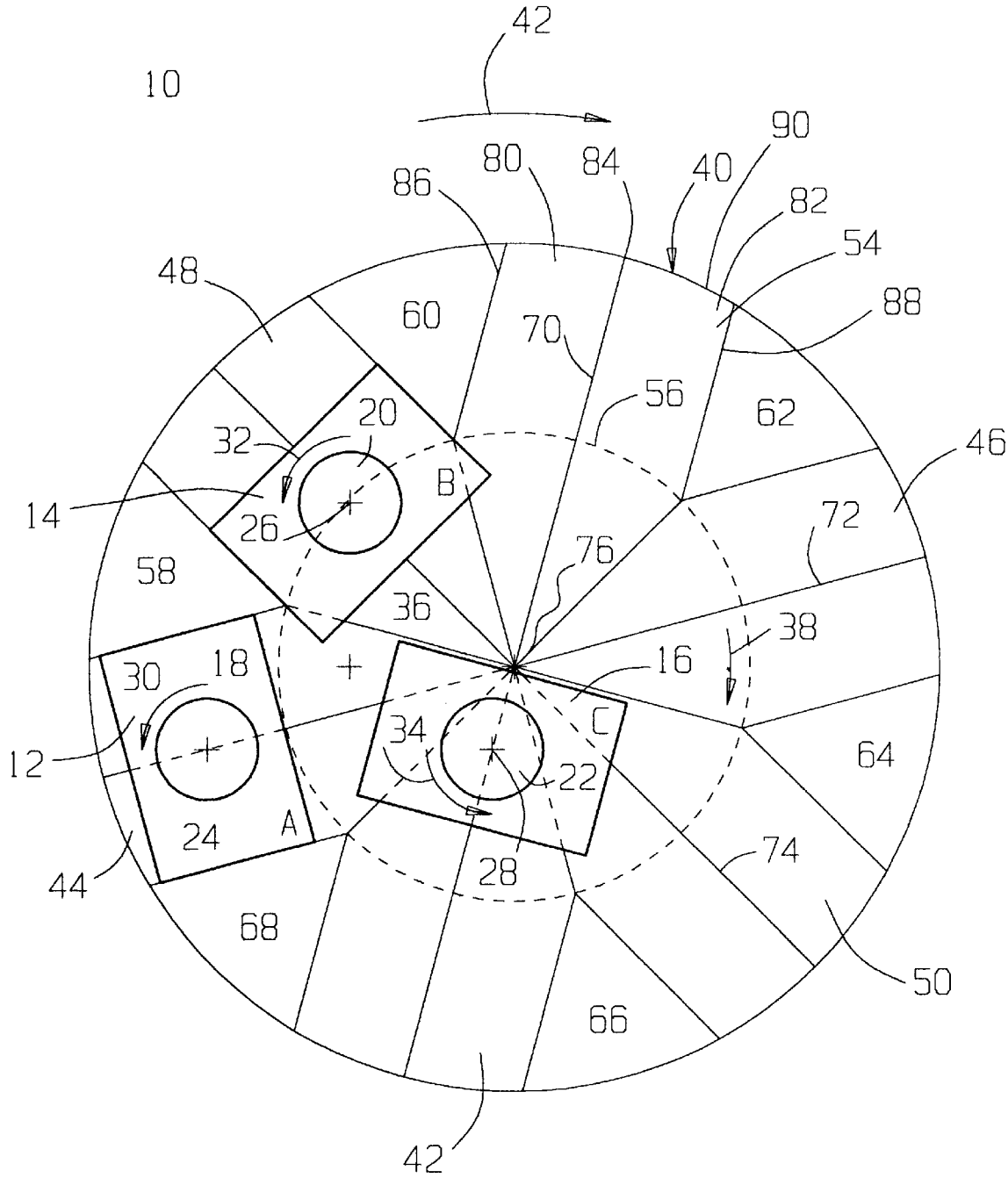
FIGS. 1–4 are illustrative schematic plan views of a sequence of operation of a positive displacement rotary machine according to this invention using three pistons and six radial chambers.
Figure 7:
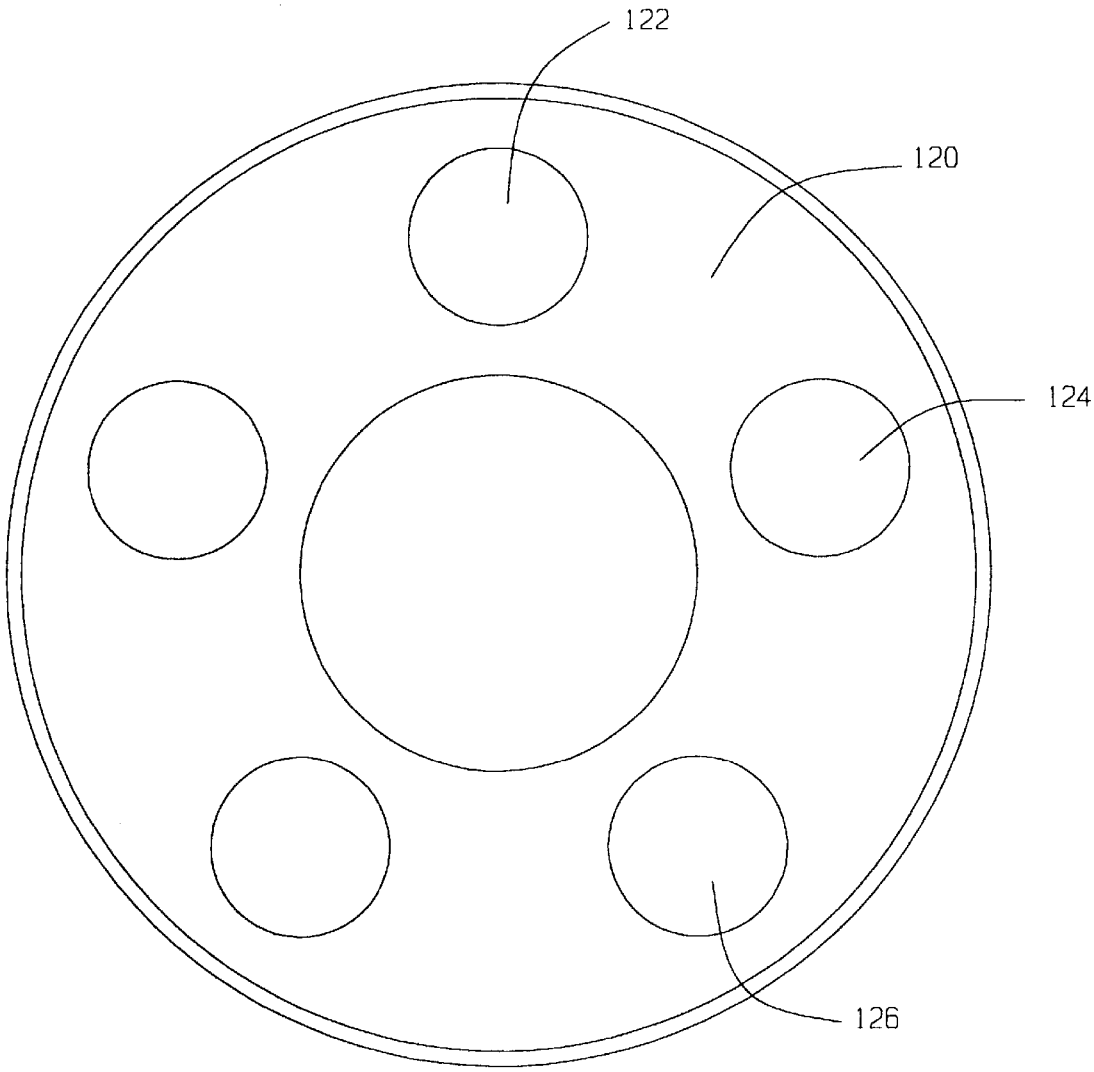
FIG. 7 is a schematic plan view of the base of the piston rotor which mounts the pistons of FIG. 6.

There is shown in FIG. 1 a rotary machine 10 according to this invention including three pistons 12, 14 and 16 each of which is rotatably mounted to a piston rotor 120, not shown in FIG. 7, by means of pivot pins 18, 20, 22, force fitted or integral with the piston rotor, so that each piston can rotate about its own axis 24, 26, 28 in the direction indicated by arrows 30, 32, 34 as the entire rotor and all three pistons rotate about the piston rotor axis 36 at the same speed but opposite to the rotor in the direction of arrow 38. Chamber rotor 40 rotates at half the piston rotor speed in the same direction indicated by arrow 42 and includes three pairs of diametrically opposed radial fluid chambers 44, 46; 48, 50; 52, 54 which are associated with pistons 12, 14 and 16, respectively. Each piston has associated with it a pair of radially opposed chambers. There are twice the number of radial chambers as there are pistons. All of the radial chambers communicate with a central common chamber 56. The radial fluid chambers are separated by lands 58, 60, 62, 64, 66 and 68.

Each pair of radial chambers, as exemplified by chambers 52 and 54, share a guide track 70 which extends from one to the other through the common chamber 56. The shape of guide track 70 is such that it kinematically constrains the piston, in this case, the piston 16, as it moves between radial chambers 52 and 54 through the common chamber 56. All of the guide tracks 70, 72 and 74 pass through the center of rotation 76 of chamber rotor 40. Each radial chamber 40, again exemplified by chamber 54, includes two downward sloping sides 80, 82 which meet at a lower apex 84 and two side walls 86 and 88 perpendicular to the paper. The top of chamber 54 in the plane of the paper and its outer end 90 are closed by a housing, not shown. The piston rotor, not shown in FIG. 1, rotates in the direction of arrow 38 about its axis 36 and the chamber rotor 40 rotates about its axis 76 in the same direction at one-half the speed of the piston rotor. The pistons 12, 14 and 16 move back and forth in their associated respective radial chambers and rotate on their pivot pins 24, 26 and 28 as necessary to remain aligned as constrained by their respective guide tracks 72, 70 and 74.

Figure 2:
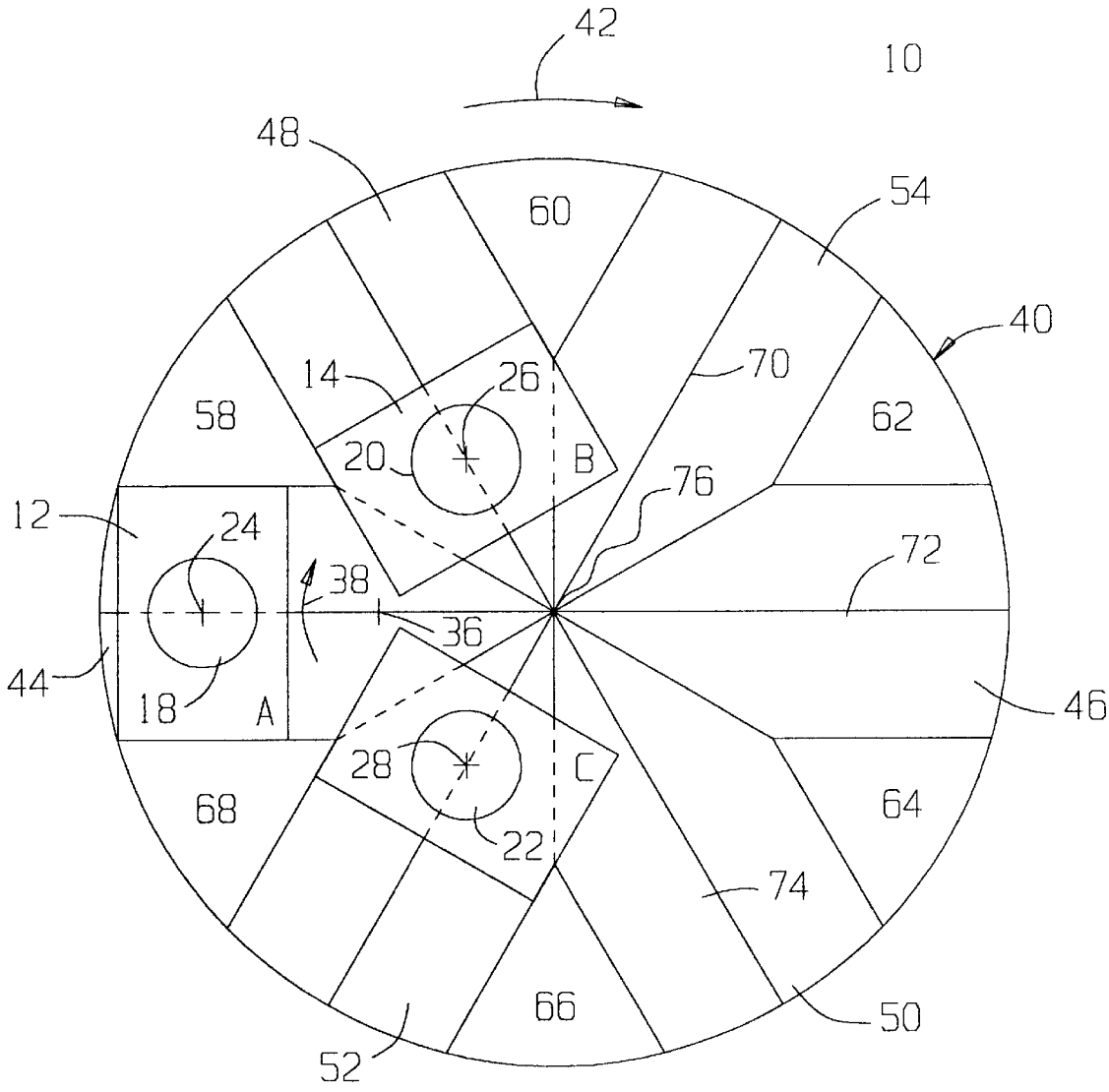
Figure 3:
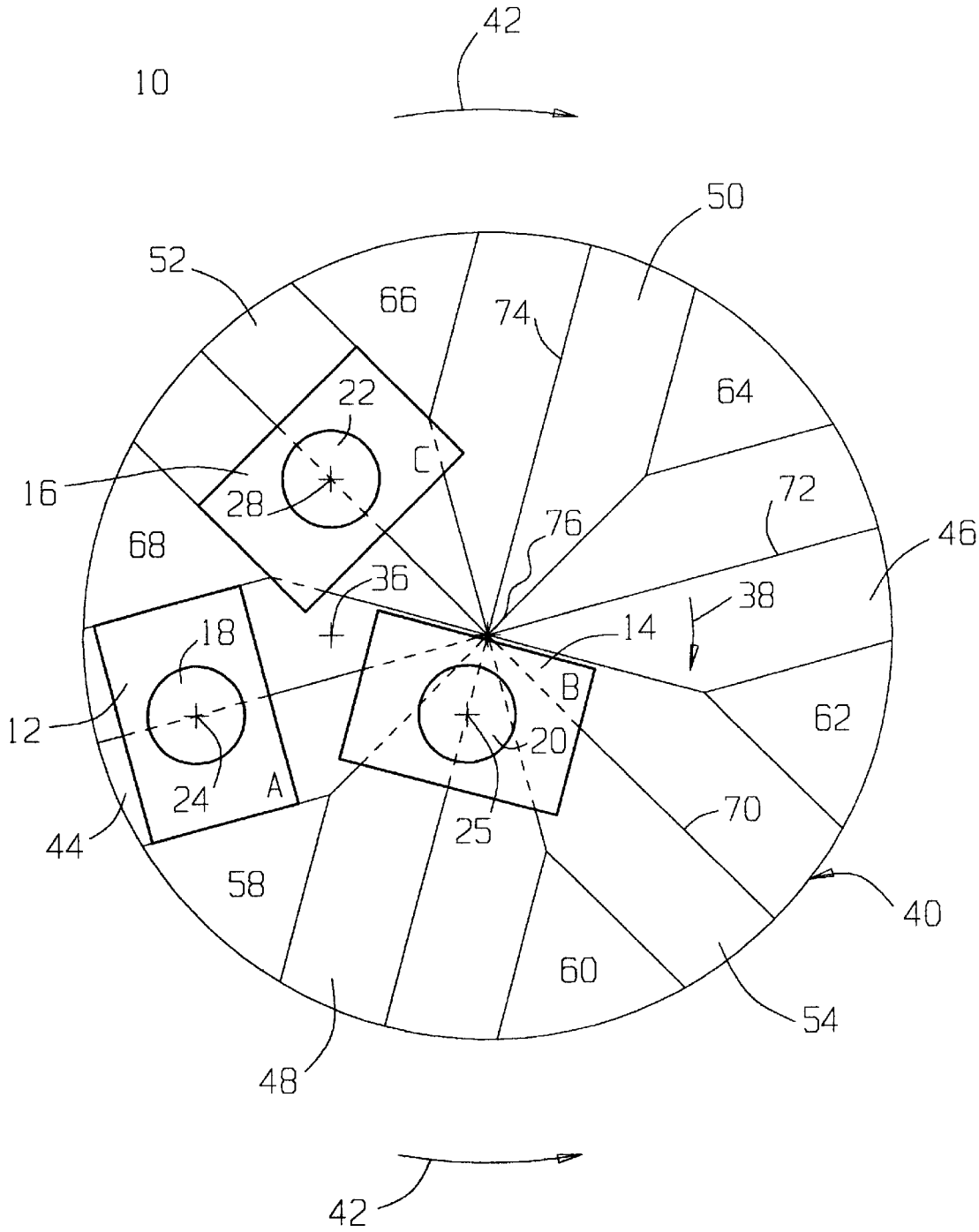
Figure 4:
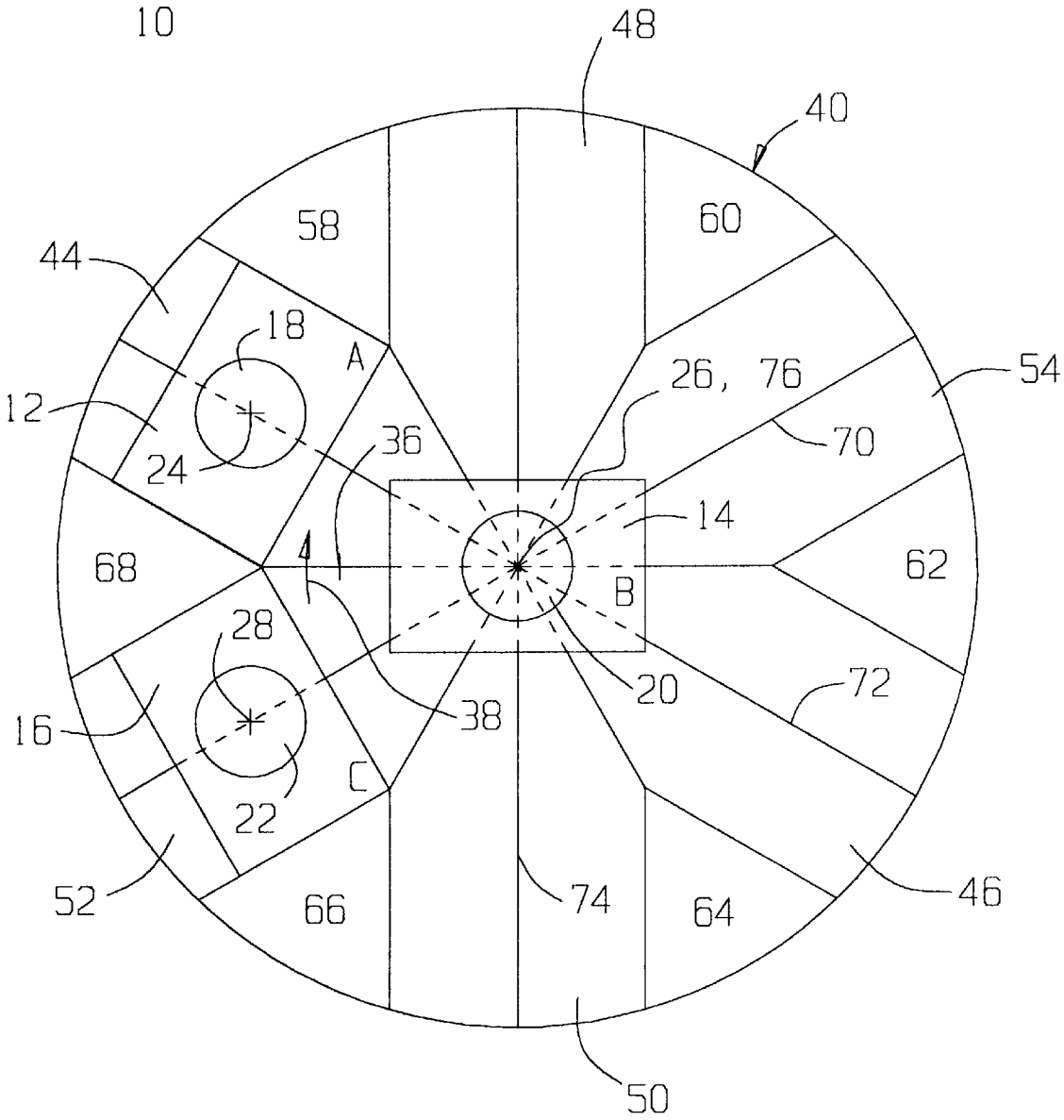

In operation, FIG. 2, with a small clockwise motion of the piston rotor in the direction of arrow 38 and the chamber rotor in the direction of arrow 42, piston 12 has moved outwardly to top dead center while piston 14 has moved inwardly towards bottom dead center and piston 16 has moved outwardly from a position in common chamber 16 in FIG. 1 to a position just above bottom dead center in FIG. 2. With continued motion, as shown in FIG. 3, piston 12 recedes from top dead center, piston 14 moves further into the common chamber 56, and piston 16 moves further outwardly in its radial chamber, and in FIG. 4 piston 12 has withdrawn even further in its radial chamber, piston 14 has now moved to the halfway point between its radial chambers 54 and 52 where it is right at the center of common chamber 56 and piston 16 has moved closer to the top dead center position in its radial chamber 44.

Figure 5:
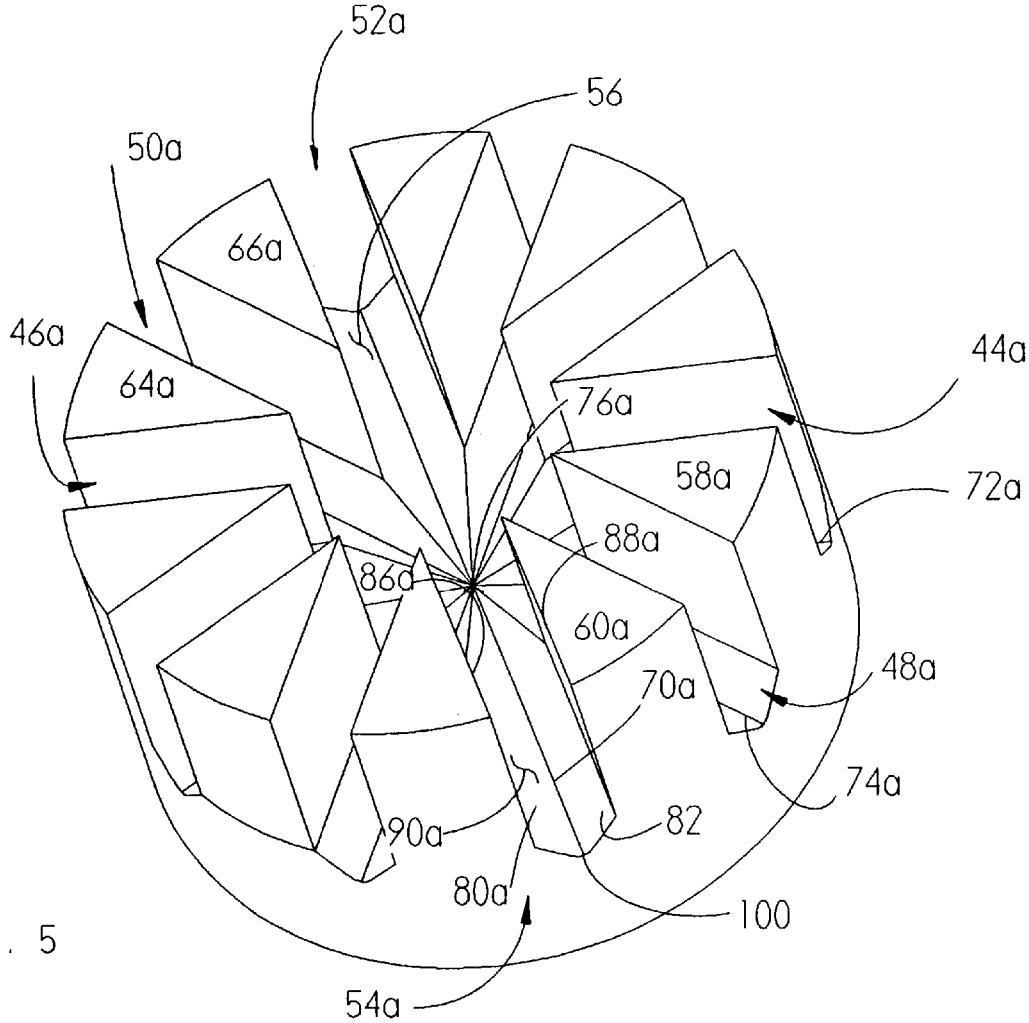
FIG. 5 is a schematic three-dimensional view of a chamber rotor according to this invention with ten radial chambers for accommodating five pistons.

The construction of a chamber rotor is shown in more detail in FIG. 5. In FIG. 5 and the following figures, like parts have been given like numbers and similar parts have been given like numbers accompanied by a lower case letter or a prime. Chamber rotor 40*a,* FIG. 5, differs somewhat from chamber rotor 40 shown in FIGS. 1–4 in that it has ten radial fluid chambers to cooperate with five pistons as opposed to the device in FIGS. 1–4 where only three pistons are cooperating with six radial fluid chambers. Chamber rotor 40*a,* FIG. 5, however, illustrates more clearly one particular embodiment of the chambers. Here can be seen clearly the shape of the chambers as illustrated by radial fluid chamber 54*a,* where the sloping sides 80*a* and 82*a* meet at an apex or a point to form track 70*a*. In FIG. 15 sides 80*a* and 82*a* meet preferably at a 75° to 90° angle. Although the track is generally pointed, a small radius 100 may be used for easier machining, control of leakage flow and smoother operation. However, any manner of guide track which constrains the movement of the pistons from one of its radial fluid chambers to the other across the common chamber 56 will satisfy the invention. Without the open area provided by the common chamber 56, the pistons would be unable to move back and forth between their radial chambers, but without the continuous guide tracks the pistons would not move smoothly through that open common chamber 56.

Figure 6:
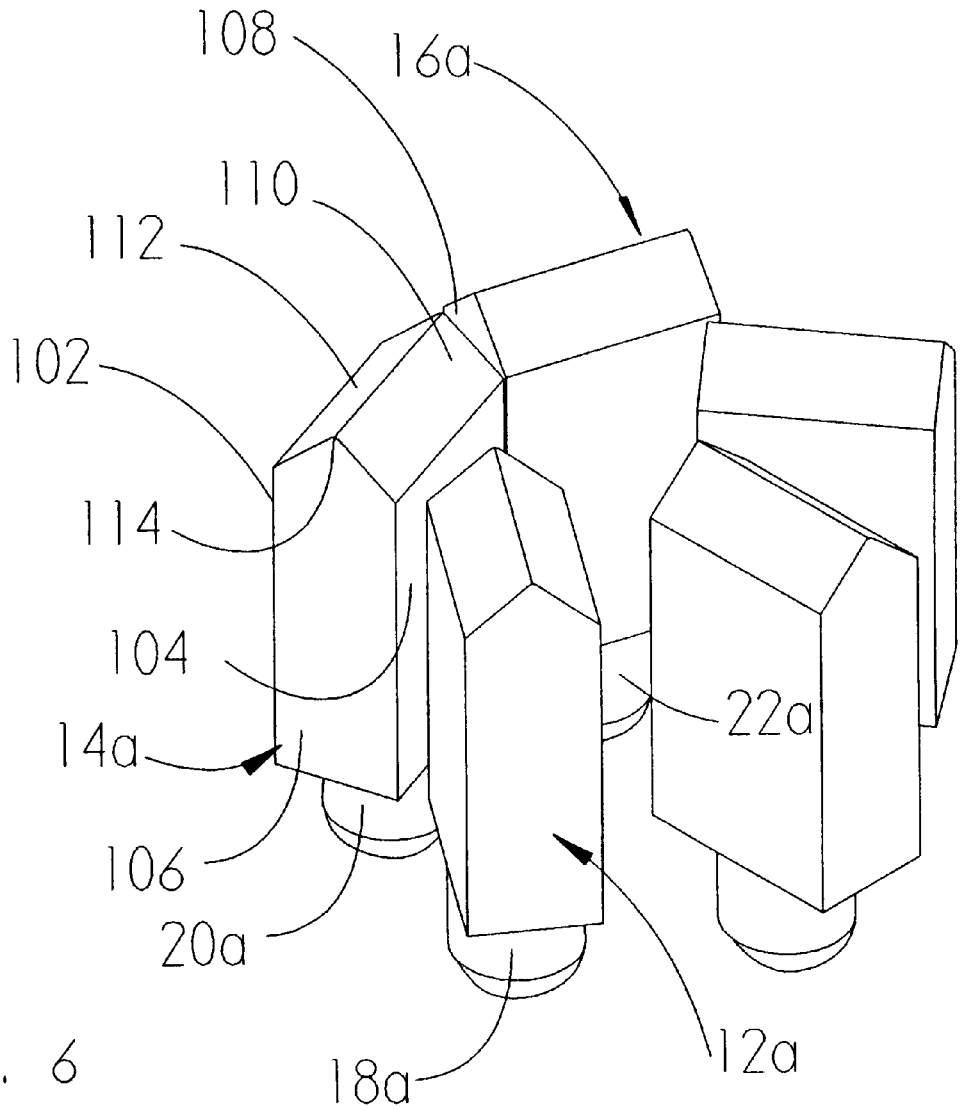
FIG. 6 is a schematic three-dimensional view of five pistons for engagement with the rotor for assembly with the chamber rotor of FIG. 5.

The five pistons which engage with the ten radial fluid chambers of chamber rotor 40*a,* FIG. 5, are shown in FIG. 6. Each piston, as exemplified for example by piston 14*a,* has flat sides 102, 104, flat ends 106 and 108, not visible, and a lower portion which has sloping sides 110 and 112 to form a triangular apex 114 including a small radius which nicely conforms with the contours of the radial chambers in FIG. 5 to control leakage flow. The pivot pins including 18*a,* 20*a* and 22*a* on which pistons 12*a,* 14*a* and 16*a,* respectively, are free to rotate about their own axes, are mounted in piston rotor base 120, FIG. 7, which includes five bores such as bores 122, 124 and 126 for receiving pivot pins 18*a,* 20*a* and 22*a.* Although the pistons in FIG. 1 have been shown as pivotally mounted for rotation about their pins 18, 20 and 22, this is not a necessary limitation of the invention. For example, the pins may be force fitted into the pistons and rotatably mounted in the base 120 or the pistons may have the pins an integral part of their design as shown in FIG. 6. This is a matter of design choice for cost and strength considerations.

The piston and piston rotor and the radial chambers and chamber rotor are all rotatable in the same plane for perfect balance. Either rotor can be the driven or driver: either one can provide the output rotary power or accept the input rotary power. Often the chamber rotor is chosen as the input/output because it moves at half the speed of the piston rotor. The guide track is generally continuous in the radial chambers and across the common chamber to facilitate smooth operation. Discontinuities can be tolerated, though are not preferred.

Although thus far the cross section of the pistons has been shown as rectangular with a triangular bottom, this is not a necessary limitation of the invention as any shape which provides the necessary displacement and adequately engages with the guide track to prevent rotation of the piston out of the track, particularly when crossing the center of chamber 56, will suffice. The measure of the adequacy is the kinematic constraint imposed on the piston as it moves from one of its radial chambers to the other through the common chamber. For example, in FIGS. 8A–C, other cross-sections for a piston are suggested. In FIG. 8A the piston 12' has an elliptical or parabolic preferred cross-section with a flat top and small track radius. Piston 12", FIG. 8B, has a small radius teardrop shape. Piston 12'", FIG. 8C, is generally rectangular with an apex at its lower end as shown in FIGS. 5 and 6.

The guide track may take any shape so long as it provides a kinematic constraint on the movement of the piston from radial chamber to radial chamber through the common chamber. While some discontinuity in the track may be permissible, the kinematic chaining or constraint should be constant to provide the smooth, impact-free operation between chambers that is desirable.

The relationships of the various parts may be better understood with reference to an explanation of the design for maximum pump or motor displacement per revolution for a given diameter and number of pistons as follows, where:

$\phi$ is the angle from chamber radial center to the chamber radial edge;

$\theta$ is the angle between the chamber radial edge and is equal to $2\phi$;

N is the number of pistons;

$R_{rc}$ is the distance from the center of the chamber rotor to top dead center $$\left(R_{rc} = \sqrt{R_M^2 - R^2}\right);$$

$R_m$ is the radius of the chamber rotor;

R is one half the width of a piston;

P is the length of a piston;

Y is the effective length of the chamber;

Z is the length of the remainder of the chamber;

$R_{cc}$ is the length of the chamber radial edge;

X is the distance between the center of the chamber rotor and the center of the piston rotor, X is also the distance between the center of the piston rotor $$\left(X = \frac{R_{rc} - P}{Z}\right)$$

as shown in FIGS. 20, 21 and 22.

The pistons must not have contact interference during rotation. Once X and $R_{rc}$ are determined P will be easily determined by the position of pistons X' and X" in FIG. 22.

This relative piston location at the apex of L and Y' can be determined graphically or analytically by known methods to determine the maximum value of P to prevent edge or corner interference of the pistons during relative rotation.

$$\left(L = \sqrt{R^2 + P^2}\right),$$

then $$X = \frac{R_{RC} - P}{2}$$

can be determined, where X is the eccentricity between the chamber and piston rotors.

Once this two-dimensional component of displacement is determined it need only be multiplied by the depth of the chamber along the direction of the rotational axes of the rotors to obtain full three-dimensional displacement volume.

$$\phi = \frac{90}{N}; \quad 2\phi = \theta \tag{1}$$

$$R_{rc} = \sqrt{\frac{Rm^2}{\frac{1+\tan^2\phi}{4}}} \tag{2}$$

$$R = 2\frac{R_{rc}}{2}\tan\phi \tag{3}$$

$$Y = Z = \frac{R_{rc}}{2} \tag{4}$$

$$R_{cc} = \frac{R_{rc}}{2\cos\phi} \tag{5}$$

$$X = \frac{R_{rc} - P}{2} \tag{6}$$

By selectively porting either through side walls or peripheral walls, the positive displacement rotary machine of this invention can be made to operate as a number of different types of machines, e.g., a fluid pump or motor, a vacuum pump, air compressor, expandor, or even an engine.

There is shown in FIG. 9 a device 200 which may be operated as either a fluid motor or a fluid pump which is enclosed in a housing 202 that has two ports 204 and 206. Port 206 is indicated as the intake port and 204 as the exhaust port. However, these may be interchanged. If a fluid pressure is provided at the intake port then the device will be operated as a fluid motor. If the device itself provides pressurized fluid at the exhaust port then the device is operating as a fluid pump which must be driven by an external source of rotary power. With fluid pump/motor 200 the ports are peripheral and they extend over the period when each of the pistons moves between top dead center and bottom dead center in each of its associated pair of radial chambers. Here again the device includes five pistons 208, 210, 212, 214 and 216 rotatably mounted on pins 218, 220, 222, 224, 226 for rotation about their own rotational axis 228, 230, 232, 234 and 236, respectively. All of the pistons are mounted on the piston rotor, not shown, which rotates in the direction of arrow 238 about the piston rotor axis 240. Chamber rotor 242 rotates in the direction of arrow 244 about its axis 246. And there are ten radial fluid chambers 248, 250, 252, 254, 256, 258, 260, 262, 264 and 266 in which the pistons move to and fro through common chamber 268 under the kinematic constraint of guide tracks 270, 272, 274, 276, 278, respectively.

In another embodiment the hydraulic pump or motor 280, FIGS. 10 and 11, includes but three pistons 282, 284 and 286 each of which is provided with circumferential sealing rings 288, 290, 292, 294, 296, 298, to prevent side leakage as the pistons move between their associated radial chambers 296, 298, 300 302, 304 and 306 through common chamber 299 in chamber rotor 301 along guide tracks 308, 310 and 312. In addition, each of the radial chambers is provided with end seals 314, 316, 318, 320, 322, 324 to prevent leakage between chamber rotor 326 and housing 328. A thrust washer, or pressurize fluid spring may be provided to force the pistons and piston rotor against the chamber rotor to control leakage flow. Intake port 330 extends over the period where the pistons move from top dead center to bottom dead center or where the pistons leave the chamber, as the two rotors rotate in the direction as indicated by arrow 332. A substantial portion of the remainder of the housing may be ported as the exhaust port. When the device is operated as a hydraulic motor, pressurized fluid is provided at intake port 330. When it is operated as a pump the direction can be reversed so that the intake port becomes the exhaust port and pressurized fluid is provided there. The pressurized fluid to operate it as a hydraulic motor can be provided through conduit 334 and servo valve 336. In addition, where it is desirable to vary the displacement of the fluid machine, a slide valve 335 may be utilized as shown in FIG. 23.

In FIG. 11 it can be seen that the piston rotor includes base 336 mounted on axle 338 rotatable in bearings 340 and 342 in housing 328. Base plate 336 mounts the three pistons 282, 284 and 286 which have teardrop shaped cross-sections and are pivotably mounted in base 336. The end seals 314, 318 on radial chamber 292 are shown in FIG. 11. Chamber rotor 301 is shown with portions removed and its axle 344 rotatably mounted in bearings 346 and 348.

A vacuum pump as shown in FIGS. 12 and 13 can be implemented in the same fashion as the hydraulic motor/pump of FIGS. 10 and 11 with the exception that the conduit 334*a* is connected to a container to be evacuated and a vacuum valve 336*a* is used at the intake port instead of a servo valve. The pistons, the radial and common chambers, the housing and the porting are the same. In FIGS. 12 and 13 like numbers have been applied to like parts accompanied by a lower case a with respect to those parts in FIGS. 10 and 11.

For implementation as an air compressor, FIGS. 14, 15 and 16, the rotary device according to this invention has a slightly smaller intake port 330*b* and the conduit 334*b* is connected to a tank for storing compressed fluid and a suitable valve 336*b* is employed in place of the vacuum valve 336*a*. In FIG. 15 the end seals, as exemplified by end seal 318*b* on radial chamber 292*b*, which is also used in FIGS. 10–13, is shown more clearly.

In a final example of the versatility of the rotary machine of this invention there is shown an implementation as a two-cycle, scavenged intake and exhaust, heat engine wherein a fuel injector 350 fires the charge at top dead center and the intake 330*c* and exhaust 331 ports are interconnected through common chamber 299*c* for complete scavenging.

The rotary machine of this invention may also serve as a variable volume device by adding a moving valve such as slide valve 335 at the intake, FIG. 23.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A positive displacement rotary machine comprising:

a piston rotor rotatable about a first axis and including a number of pistons equally spaced about said first axis and rotatably mounted about their axes on said piston rotor;

a chamber rotor rotatable about a second axis spaced from said first axis, including a central common chamber and a number of radial fluid chambers arranged in diametrically opposed pairs across said common chamber, and guide tracks extending between opposing said pairs of radial chambers across said common chamber for kinematically constraining each of said pistons as they move from one of their associated radial chambers to the other through said common chamber; and intake and exhaust ports for introducing and exhausting fluid from said radial chambers.

2. The positive displacement rotary machine of claim 1 in which each of said pistons and its associated said radial chambers have the same cross-sectional shape.

3. The positive displacement rotary machine of claim 1 in which said guide tracks are continuous through said common chamber.

4. The positive displacement rotary machine of claim 1 in which said guide tracks form a part of their associated pairs of said radial chambers.

5. The positive displacement rotary machine of claim 1 in which said pistons have their portions which engage their associated guide tracks conforming in shape to the shape of said guide tracks.

6. The positive displacement rotary machine of claim 1 in which pistons and said radial chambers are all in the same plane.

7. The positive displacement rotary machine of claim 1 in which said guide tracks are generally triangular in cross-section shape.

8. The positive displacement rotary machine of claim 7 in which said triangular guide tracks have an apex of approximately 90° or less.

9. The positive displacement rotary machine of claim 8 in which said triangular guide tracks have an apex of approximately 75–90°.

10. The positive displacement rotary machine of claim 1 in which the ratio of the radius of the radial chambers to that of the common chamber is twice the cosine of $\phi$ where $\phi=90°/N$ and where N is the number of pistons.

11. The positive displacement rotary machine of claim 1 in which the length of the piston is 2P where $P=R_{rc}-2\cdot X$ and the width of the piston is 2R where $$R = \frac{R_{RC}}{2}\tan\phi$$

.

12. The positive displacement rotary machine of claim 1 in which said intake port and said exhaust port each extend along the said chamber rotor over the period when each piston moves between top dead center and bottom dead center in each of its associated pair of radial chambers.

13. The positive displacement rotary machine of claim 1 further including a radial sliding valve at the intake port for varying the displacement.

14. The positive displacement rotary machine of claim 12 in which one of said rotors is connected to a source of input rotary power and said intake port is connected to a source of fluid and the fluid is provided pressurized at said exhaust port and the rotary machine is operated as a fluid pump.

15. The positive displacement rotary machine of claim 12 in which said intake port is connected to a source of pressurized fluid, and one of said rotors is connected to a drive device for providing output rotary power and the rotary machine is operated as a fluid motor.

16. The positive displacement rotary machine of claim 12 in which said exhaust port is connected to a container to be evacuated, said exhaust port extends along the chamber rotor over the period when each piston approaches bottom dead center, one of said rotors is connected a drive device or providing input rotary power and the rotary machine is operated as a vacuum pump.

17. The positive displacement rotary machine of claim 1 in which at least one of said intake and exhaust ports is located in a side wall.

18. The positive displacement rotary machine of claim 12 in which said exhaust port is connected to a compressor tank, said intake port extends along the chamber rotor over the period when each piston approaches top dead center, one of said rotors is connected to a drive device for providing input rotary power and the rotary machine is operated as a compressor.

19. The positive displacement rotary machine of claim 1 in which said intake and exhaust ports extend along the said chamber rotor over the period when each piston moves from bottom dead center of its exhaust stroke in one of its associated radial chambers to bottom dead center of its intake stroke in the other of its associated radial chambers, one of said rotors is connected to a drive device for providing rotary output power, and the rotary machine is operated as a two stroke scavenged intake and exhaust engine.

20. The positive displacement rotary machine of claim 14 in which said chamber rotor is connected to a source of rotary power.

21. The positive displacement rotary machine of claim 15 in which said chamber rotor is connected to a drive device.

22. The positive displacement rotary machine of claim 16 in which said chamber rotor is connected to a drive device.

23. The positive displacement rotary machine of claim 18 in which said chamber rotor is connected to a drive device.

24. The positive displacement rotary machine of claim 1 in which each of said pistons includes at least one circumferential seal or split ring for sealing between the piston and radial chamber.

25. The positive displacement rotary machine of claim 24 in which said circumferential seal includes a split ring seal.

26. The positive displacement rotary machine of claim 15 in which said in which said radial chambers extend through said chamber rotor to its outer periphery.

27. The positive displacement rotary machine of claim 26 further including a housing having a peripheral wall for closing the outer periphery of said chamber rotor.

28. The positive displacement rotary machine of claim 27 in which each said radial chamber includes an annular seal for sealing between each radial chamber and said housing.

29. The positive displacement rotary machine of claim 27 in which said intake and exhaust ports are in said peripheral wall.

30. The positive displacement rotary machine of claim 26 in which said radial chambers are open on opposite sides and said housing has side walls for closing said open opposite sides.

31. The positive displacement rotary machine of claim 1 in which each said piston includes a piston pivot pin which is rotatably mounted in said piston rotor.

32. The positive displacement rotary machine of claim 1 in which said piston rotor includes a number of pivot pins, one for rotatably mounting each of said pistons.

33. The positive displacement rotary machine of claim 16 further including a vacuum valve for maintaining the vacuum at the intake port.

34. The positive displacement rotary machine of claim 18 further including a pressure valve for maintaining the pressure at the exhaust port.

35. A positive displacement rotary fluid pump comprising:

a piston rotor rotatable about a first axis and including a number of pistons equally spaced about said first axis and rotatably mounted about their axes on said piston rotor;

a chamber rotor rotatable about a second axis spaced from said first axis, including a central common chamber and a number of radial fluid chambers arranged in diametrically opposed pairs across said common chamber, and guide tracks extending between opposing said pairs of radial chambers across said common chamber for kinematically constraining each of said pistons as they move from one of their associated radial chambers to the other through said common chamber; and intake and exhaust ports for introducing and exhausting fluid from said radial chambers;

said intake and exhaust ports each extend along the said chamber rotor over the period when each piston moves between top dead center and bottom dead center in each of its associated pair of radial chambers;

one of said rotors is connected to a source of rotary input power, said intake port is connected to a source of fluid and the fluid is provided pressurized at said exhaust port.

36. A positive displacement rotary fluid motor a piston rotor rotatable about a first axis and including a number of pistons equally spaced about said first axis and rotatably mounted about their axes on said piston rotor;

a chamber rotor rotatable about a second axis spaced from said first axis, including a central common chamber and a number of radial fluid chambers arranged in diametrically opposed pairs across said common chamber, and guide tracks extending between opposing said pairs of radial chambers across said common chamber for kinematically constraining each of said pistons as they move from one of their associated radial chambers to the other through said common chamber; and intake and exhaust ports for introducing and exhausting fluid from said radial chambers;

said intake and exhaust ports each extend along the said chamber rotor over the period when each piston moves between top dead center and bottom dead center in each of its associated pair of radial chambers;

said intake port is connected to a source of pressurized fluid, and one of said rotors is connected to a drive device for providing output rotary power.

37. A positive displacement rotary vacuum pump comprising:

a piston rotor rotatable about a first axis and including a number of pistons equally spaced about said first axis and rotatably mounted about their axes on said piston rotor;

a chamber rotor rotatable about a second axis spaced from said first axis, including a central common chamber and a number of radial fluid chambers arranged in diametrically opposed pairs across said common chamber, and guide tracks extending between opposing said pairs of radial chambers across said common chamber for kinematically constraining each of said pistons as they move from one of their associated radial chambers to the other through said common chamber; and intake and exhaust ports for introducing and exhausting fluid from said radial chambers;

said exhaust port is connected to a container to be evacuated, said exhaust port extends along the chamber rotor over the period when each piston approaches bottom dead center, and one of said rotors is connected to a drive device for providing rotary input power.

38. A positive displacement rotary compressor comprising:

a piston rotor rotatable about a first axis and including a number of pistons equally spaced about said first axis and rotatably mounted about their axes on said piston rotor;

a chamber rotor rotatable about a second axis spaced from said first axis, including a central common chamber and a number of radial fluid chambers arranged in diametrically opposed pairs across said common chamber, and guide tracks extending between opposing said pairs of radial chambers across said common chamber for kinematically constraining each of said pistons as they move from one of their associated radial chambers to the other through said common chamber; and intake and exhaust ports for introducing and exhausting fluid from said radial chambers; said exhaust port is connected to a compressor tank, said intake port extends along the chamber rotor over the period when each piston approaches top dead center; and one of said rotors is connected to a drive device for providing rotary input power.

39. A positive displacement rotary two stroke scavenged intake and exhaust engine comprising:

a piston rotor rotatable about a first axis and including a number of pistons equally spaced about said first axis and rotatably mounted about their axes on said piston rotor;

a chamber rotor rotatable about a second axis spaced from said first axis, including a central common chamber and a number of radial fluid chambers arranged in diametrically opposed pairs across said common chamber, and guide tracks extending between opposing said pairs of radial chambers across said common chamber for kinematically constraining each of said pistons as they move from one of their associated radial chambers to the other through said common chamber; and intake and exhaust ports for introducing and exhausting fluid from said radial chambers;

said intake and exhaust ports extend along the said chamber rotor over the period when each piston moves from bottom dead center of its exhaust stroke in one of its associated radial chambers to bottom dead center of its intake stroke in the other of its associated radial chambers and one of said rotors is connected to a drive device for providing rotary output power.

* * * * *